US008210944B2

(12) United States Patent
Mead

(10) Patent No.: US 8,210,944 B2
(45) Date of Patent: Jul. 3, 2012

(54) GAMING SYSTEM HAVING DISPLAY DEVICE WITH CHANGEABLE WHEEL

(75) Inventor: Dennis K. Mead, Carson City, NV (US)

(73) Assignee: IGT, Reno, NV (US)

( * ) Notice: Subject to any disclaimer, the term of this patent is extended or adjusted under 35 U.S.C. 154(b) by 1144 days.

(21) Appl. No.: 11/927,047

(22) Filed: Oct. 29, 2007

(65) Prior Publication Data

US 2009/0111577 A1 Apr. 30, 2009

(51) Int. Cl.
*A63F 9/24* (2006.01)

(52) U.S. Cl. ..... 463/31; 463/16; 463/20; 273/142 R

(58) Field of Classification Search ..... 273/142 R; 463/31

See application file for complete search history.

(56) References Cited

U.S. PATENT DOCUMENTS

| | | | |
|---|---|---|---|
| 1,978,395 | A | 4/1934 | Groetchen |
| 2,545,644 | A | 3/1951 | Benton et al. |
| 3,420,525 | A | 1/1969 | Waders |
| 3,642,287 | A | 2/1972 | Lally et al. |
| 3,708,219 | A | 1/1973 | Forlini et al. |
| 3,735,987 | A | 5/1973 | Ohki |
| 3,975,022 | A | 8/1976 | Figueroa |
| 4,326,351 | A | 4/1982 | Heywood et al. |
| 4,333,715 | A | 6/1982 | Brooks |
| 4,410,178 | A | 10/1983 | Partridge |
| 4,448,419 | A | 5/1984 | Telnaes |
| 4,517,558 | A | 5/1985 | Davids |
| 4,607,844 | A | 8/1986 | Fullerton |
| 4,621,814 | A | 11/1986 | Stepan et al. |
| 4,659,182 | A | 4/1987 | Aizawa |
| 4,695,053 | A | 9/1987 | Vazquez, Jr. et al. |
| 4,718,672 | A | 1/1988 | Okada |
| 4,732,386 | A | 3/1988 | Rayfiel |
| 4,911,449 | A | 3/1990 | Dickinson et al. |
| 4,912,548 | A | 3/1990 | Shanker et al. |
| 4,978,129 | A | 12/1990 | Komeda et al. |
| 5,058,893 | A | 10/1991 | Bertram et al. |
| 5,086,354 | A | 2/1992 | Bass et al. |
| 5,113,272 | A | 5/1992 | Reamey |
| 5,132,829 | A | 7/1992 | Travis |
| 5,152,529 | A | 10/1992 | Okada |
| 5,319,491 | A | 6/1994 | Selbrede |
| 5,342,047 | A | 8/1994 | Heidel et al. |

(Continued)

FOREIGN PATENT DOCUMENTS

| | | |
|---|---|---|
| AU | 199650720 | 10/1996 |

(Continued)

OTHER PUBLICATIONS

Debut of the Let's Make a Deal slot Machine [online] [retrieved on Dec. 3, 2002]. Retrieved from the Internet at <URL: www.letsmakeadeal.com/pr01.htm>.

(Continued)

*Primary Examiner* — Corbett B Coburn
(74) *Attorney, Agent, or Firm* — Neal, Gerber & Eisenberg LLP

(57) ABSTRACT

A gaming device having a display device including one or more display screens and a blank physical mechanical rotatable wheel mounted behind the display screen(s). Each display screen is capable of showing one or more images in a coordinated manner with the blank mechanical wheel. The display device is particularly suited for a server based gaming environment as discussed below, where the symbols on the mechanical wheel may need to be different for different games caused to be displayed by a central server.

17 Claims, 15 Drawing Sheets

U.S. PATENT DOCUMENTS

| | | | |
|---|---|---|---|
| 5,364,100 | A | 11/1994 | Ludlow et al. |
| 5,375,830 | A | 12/1994 | Takemoto et al. |
| 5,376,587 | A | 12/1994 | Buchmann et al. |
| 5,395,111 | A | 3/1995 | Inoue |
| 5,449,173 | A | 9/1995 | Thomas et al. |
| 5,467,893 | A | 11/1995 | Landis, II et al. |
| 5,539,547 | A | 7/1996 | Ishii et al. |
| 5,560,603 | A | 10/1996 | Seelig et al. |
| 5,580,055 | A | 12/1996 | Hagiwara |
| 5,584,763 | A | 12/1996 | Kelly et al. |
| 5,584,764 | A | 12/1996 | Inoue |
| 5,585,821 | A | 12/1996 | Ishikura et al. |
| 5,589,980 | A | 12/1996 | Bass et al. |
| 5,609,524 | A | 3/1997 | Inoue |
| 5,655,965 | A | 8/1997 | Takemoto et al. |
| 5,664,998 | A | 9/1997 | Seelig et al. |
| 5,722,891 | A | 3/1998 | Inoue |
| 5,745,197 | A | 4/1998 | Leung et al. |
| 5,752,881 | A | 5/1998 | Inoue |
| 5,764,317 | A | 6/1998 | Sadovnik et al. |
| 5,788,573 | A | 8/1998 | Baerlocher et al. |
| 5,823,872 | A | 10/1998 | Prather et al. |
| 5,823,874 | A | 10/1998 | Adams et al. |
| D400,597 | S | 11/1998 | Hedrick et al. |
| D402,702 | S | 12/1998 | Seelig et al. |
| 5,848,932 | A | 12/1998 | Adams |
| 5,863,249 | A | 1/1999 | Inoue |
| D406,865 | S | 3/1999 | Heidel |
| 5,882,261 | A | 3/1999 | Adams |
| 5,910,046 | A | 6/1999 | Wada et al. |
| 5,911,418 | A | 6/1999 | Adams et al. |
| 5,927,714 | A | 7/1999 | Kaplan |
| 5,947,820 | A | 9/1999 | Morro et al. |
| 5,951,397 | A | 9/1999 | Dickinson |
| 5,956,180 | A | 9/1999 | Bass et al. |
| 5,967,893 | A | 10/1999 | Lawrence et al. |
| 5,976,015 | A | 11/1999 | Seelig et al. |
| 5,984,782 | A | 11/1999 | Inoue |
| 5,997,401 | A | 12/1999 | Crawford |
| 6,001,016 | A | 12/1999 | Walker et al. |
| 6,004,207 | A | 12/1999 | Wilson, Jr. et al. |
| 6,015,346 | A | 1/2000 | Bennett |
| 6,027,115 | A | 2/2000 | Griswold et al. |
| 6,050,895 | A | 4/2000 | Luciano, Jr. et al. |
| 6,054,969 | A | 4/2000 | Haisma |
| 6,056,642 | A | 5/2000 | Bennett |
| 6,059,658 | A | 5/2000 | Mangano et al. |
| 6,086,066 | A | 7/2000 | Takeuchi et al. |
| 6,089,977 | A | 7/2000 | Bennett |
| 6,089,978 | A | 7/2000 | Adams |
| 6,105,962 | A | 8/2000 | Malavazos et al. |
| 6,113,098 | A | 9/2000 | Adams |
| 6,135,884 | A | 10/2000 | Hedrick et al. |
| 6,142,873 | A | 11/2000 | Weiss et al. |
| 6,142,874 | A | 11/2000 | Kodachi et al. |
| 6,159,098 | A | 12/2000 | Slomiany et al. |
| 6,162,121 | A | 12/2000 | Morro et al. |
| 6,164,645 | A | 12/2000 | Weiss |
| 6,168,520 | B1 | 1/2001 | Baerlocher et al. |
| 6,173,955 | B1 | 1/2001 | Perrie et al. |
| 6,174,234 | B1 | 1/2001 | Seibert et al. |
| 6,174,235 | B1 | 1/2001 | Walker et al. |
| 6,203,429 | B1 | 3/2001 | Demar et al. |
| D441,031 | S | 4/2001 | Seelig et al. |
| 6,213,875 | B1 | 4/2001 | Suzuki |
| 6,213,876 | B1 | 4/2001 | Moore, Jr. |
| 6,220,593 | B1 | 4/2001 | Pierce et al. |
| 6,224,483 | B1 | 5/2001 | Mayeroff |
| 6,227,970 | B1 | 5/2001 | Shimizu et al. |
| D443,313 | S | 6/2001 | Brettschneider |
| 6,244,596 | B1 | 6/2001 | Kondratjuk |
| 6,251,013 | B1 | 6/2001 | Bennett |
| 6,251,014 | B1 | 6/2001 | Stockdale et al. |
| 6,252,707 | B1 | 6/2001 | Kleinberger et al. |
| 6,254,481 | B1 | 7/2001 | Jaffe |
| 6,261,177 | B1 | 7/2001 | Bennett |
| 6,267,669 | B1 | 7/2001 | Luciano, Jr. et al. |
| 6,270,411 | B1 | 8/2001 | Gura et al. |
| 6,270,412 | B1 | 8/2001 | Crawford |
| 6,302,790 | B1 | 10/2001 | Brossard |
| 6,305,686 | B1 | 10/2001 | Perrie et al. |
| 6,312,334 | B1 | 11/2001 | Yoseloff |
| 6,315,663 | B1 | 11/2001 | Sakamoto |
| 6,315,666 | B1 | 11/2001 | Mastera et al. |
| 6,334,814 | B1 | 1/2002 | Adams |
| 6,336,863 | B1 | 1/2002 | Baerlocher et al. |
| 6,337,513 | B1 | 1/2002 | Clevenger et al. |
| 6,340,158 | B2 | 1/2002 | Pierce et al. |
| 6,347,996 | B1 | 2/2002 | Gilmore et al. |
| 6,368,216 | B1 | 4/2002 | Hedrick et al. |
| 6,379,244 | B1 | 4/2002 | Sagawa et al. |
| 6,386,974 | B1 | 5/2002 | Adams |
| 6,398,220 | B1 | 6/2002 | Inoue |
| 6,416,827 | B1 | 7/2002 | Chakrapani et al. |
| 6,419,579 | B1 | 7/2002 | Bennett et al. |
| 6,444,496 | B1 | 9/2002 | Edwards et al. |
| 6,445,185 | B1 | 9/2002 | Damadian et al. |
| 6,461,241 | B1 | 10/2002 | Webb et al. |
| D465,531 | S | 11/2002 | Luciano, Jr. et al. |
| 6,481,713 | B2 | 11/2002 | Perrie et al. |
| 6,491,583 | B1 | 12/2002 | Gauselmann |
| 6,503,147 | B1 | 1/2003 | Stockdale et al. |
| 6,511,375 | B1 | 1/2003 | Kaminkow |
| 6,512,559 | B1 | 1/2003 | Hashimoto et al. |
| 6,514,141 | B1 | 2/2003 | Kaminkow et al. |
| 6,517,432 | B1 | 2/2003 | Jaffe |
| 6,517,433 | B2 | 2/2003 | Loose et al. |
| 6,517,437 | B1 | 2/2003 | Wells et al. |
| 6,533,273 | B2 | 3/2003 | Cole et al. |
| 6,533,660 | B2 | 3/2003 | Seelig et al. |
| 6,537,152 | B2 | 3/2003 | Seelig et al. |
| 6,547,664 | B2 | 4/2003 | Sanders |
| 6,575,541 | B1 | 6/2003 | Hedrick et al. |
| 6,582,307 | B2 | 6/2003 | Webb |
| 6,585,591 | B1 | 7/2003 | Baerlocher et al. |
| 6,589,114 | B2 | 7/2003 | Rose |
| 6,605,000 | B2 | 8/2003 | Adams |
| 6,609,972 | B2 | 8/2003 | Seelig et al. |
| 6,612,574 | B1 | 9/2003 | Cole et al. |
| 6,612,575 | B1 | 9/2003 | Cole et al. |
| 6,612,927 | B1 | 9/2003 | Slomiany et al. |
| D480,961 | S | 10/2003 | Deadman |
| 6,638,167 | B1 | 10/2003 | Sawyer et al. |
| 6,646,695 | B1 | 11/2003 | Gauselmann |
| 6,652,378 | B2 | 11/2003 | Cannon et al. |
| 6,659,864 | B2 | 12/2003 | McGahn et al. |
| 6,661,425 | B1 | 12/2003 | Hiroaki |
| 6,663,488 | B1 | 12/2003 | Adams |
| 6,663,489 | B2 | 12/2003 | Baerlocher |
| 6,695,696 | B1 | 2/2004 | Kaminkow |
| 6,695,703 | B1 | 2/2004 | McGahn |
| 6,702,675 | B2 | 3/2004 | Poole et al. |
| 6,712,694 | B1 | 3/2004 | Nordman |
| 6,715,756 | B2 | 4/2004 | Inoue |
| 6,717,728 | B2 | 4/2004 | Putilin |
| 6,722,979 | B2 | 4/2004 | Gilmore et al. |
| 6,726,204 | B2 | 4/2004 | Inoue |
| D496,968 | S | 10/2004 | Baerlocher |
| 6,802,777 | B2 | 10/2004 | Seelig et al. |
| 6,817,945 | B2 | 11/2004 | Seelig et al. |
| 6,817,946 | B2 | 11/2004 | Motegi et al. |
| 6,827,646 | B2 | 12/2004 | Adams |
| D503,951 | S | 4/2005 | Karstens |
| 6,887,157 | B2 | 5/2005 | LeMay et al. |
| 6,890,254 | B2 | 5/2005 | Kaminkow |
| 6,890,259 | B2 | 5/2005 | Breckner et al. |
| 6,906,762 | B1 | 6/2005 | Witehira et al. |
| 6,908,381 | B2 | 6/2005 | Ellis |
| 6,937,298 | B2 | 8/2005 | Okada |
| 6,964,609 | B2 | 11/2005 | Haag et al. |
| 7,011,581 | B2 | 3/2006 | Cole et al. |
| 7,066,814 | B2 | 6/2006 | Glavich et al. |
| 7,095,180 | B2 | 8/2006 | Emslie et al. |
| 7,097,560 | B2 | 8/2006 | Okada |
| 7,128,647 | B2 | 10/2006 | Muir |
| 7,140,963 | B2 | 11/2006 | Kojima |
| 7,144,321 | B2 | 12/2006 | Mayeroff |

7,159,865 B2 1/2007 Okada
7,160,187 B2 1/2007 Loose et al.
7,169,048 B2 1/2007 Nozaki et al.
7,179,169 B2 2/2007 Beaulieu et al.
7,198,570 B2 4/2007 Rodgers et al.
7,204,753 B2 4/2007 Ozaki et al.
7,207,883 B2 4/2007 Nozaki et al.
7,219,893 B2 5/2007 Tanimura et al.
7,220,181 B2 5/2007 Okada
7,226,358 B2 6/2007 Miller et al.
7,234,697 B2 6/2007 Okada
7,255,643 B2 8/2007 Ozaki et al.
7,281,980 B2 10/2007 Okada et al.
7,306,520 B2 12/2007 Kaminkow et al.
7,311,598 B2 12/2007 Kaminkow et al.
7,311,604 B2 12/2007 Kaminkow et al.
7,322,884 B2 1/2008 Emori et al.
7,329,181 B2 2/2008 Hoshino et al.
7,354,342 B2 4/2008 Paulsen et al.
7,355,660 B2 4/2008 Ikeda
7,390,259 B2 6/2008 Okada
7,399,226 B2 7/2008 Mishra
7,404,766 B2 7/2008 Adachi et al.
7,458,890 B2 12/2008 Loose et al.
7,465,228 B2 12/2008 Okada
7,479,061 B2 1/2009 Okada
7,479,066 B2 1/2009 Emori
7,485,039 B2 2/2009 Okada
7,510,476 B2 3/2009 Kobayashi
7,520,812 B2 4/2009 Okada
7,585,220 B2 9/2009 Loose et al.
7,594,852 B2 9/2009 Rasmussen
7,677,572 B2 3/2010 Ozaki et al.
7,695,364 B2 4/2010 Okada
7,806,407 B2 10/2010 Ozaki et al.
7,892,094 B2 2/2011 Tanimura et al.
7,971,879 B2 7/2011 Loose et al.
7,972,206 B2 7/2011 Okada
8,007,360 B2 8/2011 Kishi
8,016,669 B2 9/2011 Okada
8,096,867 B2 1/2012 Okada
8,105,161 B2 1/2012 Rasmussen
8,123,609 B2 2/2012 Sekiguchi et al.
2001/0013681 A1 8/2001 Bruzzese et al.
2001/0024971 A1 9/2001 Brossard
2001/0054794 A1 12/2001 Cole et al.
2002/0045472 A1 4/2002 Adams
2002/0094862 A1 7/2002 Inoue
2002/0142829 A1 10/2002 Inoue
2002/0173354 A1 11/2002 Winans et al.
2003/0027624 A1 2/2003 Gilmore et al.
2003/0032478 A1 2/2003 Takahama et al.
2003/0032479 A1 2/2003 LeMay et al.
2003/0060271 A1 3/2003 Gilmore et al.
2003/0064781 A1 4/2003 Muir
2003/0087690 A1 5/2003 Loose et al.
2003/0130028 A1 7/2003 Aida et al.
2003/0176214 A1 9/2003 Burak et al.
2003/0232643 A1 12/2003 Inoue
2003/0234489 A1 12/2003 Okada
2003/0236114 A1 12/2003 Griswold et al.
2003/0236118 A1 12/2003 Okada
2004/0000754 A1 1/2004 Inoue
2004/0012145 A1 1/2004 Inoue
2004/0014516 A1 1/2004 Inoue
2004/0014517 A1 1/2004 Inoue
2004/0017041 A1 1/2004 Inoue
2004/0018866 A1 1/2004 Inoue
2004/0023714 A1 2/2004 Asdale
2004/0026854 A1 2/2004 Inoue
2004/0029636 A1 2/2004 Wells
2004/0036218 A1 2/2004 Inoue
2004/0038726 A1 2/2004 Inoue
2004/0041340 A1 3/2004 Inoue
2004/0053660 A1 3/2004 Webb et al.
2004/0053665 A1 3/2004 Baerlocher
2004/0063490 A1 4/2004 Okada
2004/0066475 A1 4/2004 Searle
2004/0077401 A1 4/2004 Schlottmann
2004/0082373 A1 4/2004 Cole et al.
2004/0102244 A1 5/2004 Kryuchkov
2004/0102245 A1 5/2004 Escalera et al.
2004/0116178 A1 6/2004 Okada
2004/0147303 A1 7/2004 Imura et al.
2004/0150162 A1 8/2004 Okada
2004/0162146 A1 8/2004 Ooto
2004/0166925 A1 8/2004 Emori et al.
2004/0171423 A1 9/2004 Silva et al.
2004/0183972 A1 9/2004 Bell
2004/0192441 A1 9/2004 Nonaka
2004/0198485 A1 10/2004 Loose et al.
2004/0209666 A1 10/2004 Tashiro et al.
2004/0209667 A1 10/2004 Emori et al.
2004/0209668 A1 10/2004 Okada
2004/0209670 A1 10/2004 Adachi et al.
2004/0209671 A1 10/2004 Okada
2004/0209672 A1 10/2004 Okada
2004/0209679 A1 10/2004 Nonaka
2004/0209683 A1 10/2004 Okada
2004/0214630 A1 10/2004 Mayeroff
2004/0214635 A1 10/2004 Okada
2004/0214636 A1 10/2004 Nonaka
2004/0214637 A1 10/2004 Nonaka
2004/0224758 A1 11/2004 Okada et al.
2004/0229686 A1 11/2004 Tanimura et al.
2004/0239582 A1 12/2004 Seymour
2004/0242323 A1 12/2004 Okada
2004/0266536 A1 12/2004 Mattice et al.
2005/0020348 A1 1/2005 Thomas et al.
2005/0020349 A1 1/2005 Tachikawa
2005/0026671 A1 2/2005 Baerlocher
2005/0032571 A1 2/2005 Asonuma
2005/0037843 A1 2/2005 Wells et al.
2005/0049032 A1 3/2005 Kobayashi
2005/0054424 A1 3/2005 Rothkranz et al.
2005/0059486 A1 3/2005 Kaminkow
2005/0062410 A1 3/2005 Bell et al.
2005/0063055 A1 3/2005 Engel
2005/0075159 A1 4/2005 Kaminkow et al.
2005/0176493 A1 8/2005 Nozaki et al.
2005/0187003 A1 8/2005 Adachi et al.
2005/0192083 A1 9/2005 Iwamoto
2005/0192084 A1 9/2005 Iwamoto
2005/0192085 A1 9/2005 Iwamoto
2005/0192090 A1 9/2005 Muir et al.
2005/0206582 A1 9/2005 Bell et al.
2005/0233799 A1 10/2005 LeMay et al.
2005/0272500 A1 12/2005 Tanimura et al.
2005/0282616 A1 12/2005 Tanimura et al.
2005/0282617 A1 12/2005 Sekiguchi et al.
2006/0040721 A1 2/2006 Cuddy et al.
2006/0046822 A1 3/2006 Kaminkow et al.
2006/0063584 A1 3/2006 Brill et al.
2006/0068875 A1 3/2006 Cregan et al.
2006/0073872 A1 4/2006 B-Jensen et al.
2006/0073873 A1 4/2006 Rodgers et al.
2006/0089192 A1 4/2006 Okada
2006/0100014 A1 5/2006 Griswold et al.
2006/0103951 A1 5/2006 Bell et al.
2006/0125745 A1 6/2006 Evanicky
2006/0199117 A1 8/2006 Engel
2006/0223627 A1 10/2006 Nozaki et al.
2006/0237905 A1 10/2006 Nicely et al.
2006/0281532 A1 12/2006 Yoshizawa
2006/0284574 A1 12/2006 Emslie et al.
2006/0290594 A1 12/2006 Engel et al.
2007/0010315 A1 1/2007 Hein
2007/0021180 A1 1/2007 Osawa
2007/0026932 A1 2/2007 Sato
2007/0060249 A1 3/2007 Gomez et al.
2007/0060296 A1 3/2007 Yoshizawa
2007/0066383 A1 3/2007 Mori et al.
2007/0066389 A1 3/2007 Kojima
2007/0072665 A1 3/2007 Muir
2007/0077986 A1 4/2007 Loose et al.
2007/0120320 A1 5/2007 Miltenberger et al.
2007/0123330 A1 5/2007 Hishinuma et al.
2007/0123332 A1 5/2007 Hishinuma et al.

| | | | |
|---|---|---|---|
| 2007/0123348 | A1 | 5/2007 | Nozaki |
| 2007/0123349 | A1 | 5/2007 | Hishinuma et al. |
| 2007/0135203 | A1 | 6/2007 | Nicely |
| 2007/0135204 | A1 | 6/2007 | Nicely |
| 2007/0158904 | A1 | 7/2007 | Okada |
| 2007/0184893 | A1 | 8/2007 | Fujimoto |
| 2007/0202948 | A1 | 8/2007 | Muir et al. |
| 2007/0206713 | A1 | 9/2007 | Yamaguchi |
| 2007/0207851 | A1 | 9/2007 | Yoshizawa |
| 2007/0218982 | A1 | 9/2007 | Baerlocher |
| 2007/0228651 | A1 | 10/2007 | Loose et al. |
| 2008/0004104 | A1 | 1/2008 | Durham et al. |
| 2008/0020820 | A1 | 1/2008 | Iwamoto |
| 2008/0096655 | A1 | 4/2008 | Rasmussen et al. |
| 2008/0113755 | A1 | 5/2008 | Rasmussen et al. |
| 2008/0125210 | A1 | 5/2008 | Iwamoto |
| 2008/0153573 | A1 | 6/2008 | Okada |
| 2008/0153574 | A1 | 6/2008 | Yoshizawa |
| 2008/0153575 | A1 | 6/2008 | Okada |
| 2008/0161087 | A1 | 7/2008 | Okada |
| 2008/0161093 | A1 | 7/2008 | Okada |
| 2008/0176653 | A1 | 7/2008 | Kishi |
| 2008/0182652 | A1 | 7/2008 | Rasmussen et al. |
| 2008/0188283 | A1 | 8/2008 | Okada |
| 2008/0214277 | A1 | 9/2008 | Kishi |
| 2008/0311977 | A1 | 12/2008 | Okada |
| 2009/0069066 | A1 | 3/2009 | Yoshizawa |
| 2009/0075718 | A1 | 3/2009 | Yoshizawa |
| 2009/0117977 | A1 | 5/2009 | Gelber et al. |
| 2009/0131145 | A1 | 5/2009 | Aoki et al. |
| 2009/0131148 | A1 | 5/2009 | Loose et al. |
| 2009/0137306 | A1 | 5/2009 | Yoshizawa |
| 2009/0181758 | A1 | 7/2009 | Loose et al. |
| 2009/0203420 | A1 | 8/2009 | Yoshizawa |
| 2009/0247276 | A1 | 10/2009 | Okada |
| 2009/0286589 | A1 | 11/2009 | Rasmussen |
| 2009/0305770 | A1 | 12/2009 | Bennett et al. |
| 2010/0081502 | A1 | 4/2010 | Rasmussen et al. |
| 2010/0093426 | A1 | 4/2010 | Ozaki et al. |
| 2010/0190552 | A1 | 7/2010 | Rasmussen et al. |
| 2010/0317427 | A1 | 12/2010 | Ozaki et al. |
| 2011/0117987 | A1 | 5/2011 | Aoki et al. |
| 2011/0124411 | A1 | 5/2011 | Tanimura et al. |

FOREIGN PATENT DOCUMENTS

| | | |
|---|---|---|
| DE | 3105266 | 9/1982 |
| EP | 0 454 423 | 10/1991 |
| EP | 0 484 103 | 5/1992 |
| EP | 0 997 857 | 5/2000 |
| EP | 1 003 138 | 5/2000 |
| EP | 1 462 152 | 9/2004 |
| GB | 912685 | 12/1962 |
| GB | 1 464 896 | 2/1977 |
| GB | 2 201 821 | 9/1988 |
| JP | 02-019182 | 1/1990 |
| JP | 04-220276 | 8/1992 |
| JP | 05-123438 | 5/1993 |
| JP | 05-123439 | 5/1993 |
| JP | 06-043425 | 2/1994 |
| JP | 06-142278 | 5/1994 |
| JP | 07-124290 | 5/1995 |
| JP | 08-173591 | 7/1996 |
| JP | 11-99240 | 4/1999 |
| JP | 11-137774 | 5/1999 |
| JP | 11-153970 | 6/1999 |
| JP | 11-244451 | 9/1999 |
| JP | 2000-011725 | 1/2000 |
| JP | 2000-267604 | 9/2000 |
| JP | 2000-300729 | 10/2000 |
| JP | 2000-350805 | 12/2000 |
| JP | 2001-062032 | 3/2001 |
| JP | 2001-161950 | 6/2001 |
| JP | 2001-190760 | 7/2001 |
| JP | 2001-238995 | 9/2001 |
| JP | 2001-252393 | 9/2001 |
| JP | 2001-252394 | 9/2001 |
| JP | 2001-305246 | 10/2001 |
| JP | 2001-327650 | 11/2001 |
| JP | 2002-017950 | 1/2002 |
| JP | 2002-078847 | 3/2002 |
| JP | 2002-085624 | 3/2002 |
| JP | 2002-113150 | 4/2002 |
| JP | 2004-166879 | 6/2004 |
| WO | WO 99/42889 | 8/1999 |
| WO | WO 99/44095 | 9/1999 |
| WO | WO 99/53454 | 10/1999 |
| WO | WO 00/32286 | 6/2000 |
| WO | WO 01/09664 | 2/2001 |
| WO | WO 01/15128 | 3/2001 |
| WO | WO 01/15132 | 3/2001 |
| WO | WO 01/55127 | 8/2001 |
| WO | WO 04/001486 | 12/2003 |
| WO | WO 2004/102520 | 11/2004 |
| WO | WO 2006/036948 | 4/2006 |
| WO | WO 2006/038819 | 4/2006 |
| WO | WO 2006/124976 | 11/2006 |
| WO | WO 2007/011717 | 1/2007 |
| WO | WO 2007/053349 | 5/2007 |
| WO | WO 2008/011049 | 1/2008 |

OTHER PUBLICATIONS

Light Valve [online] [retrieved on Nov. 15, 2005]. Retrieved from the Internet at <URL: www.meko.co.uk/lightvalve.shtml>.

Liquid Crystal Display [online] [retrieved on Nov. 16, 2005]. Retrieved from the Internet at <URL: http://en.wikipedia.org/wiki/LCD>.

Living in a Flat World? Advertisement, written by Deep Video Imaging Ltd., published in 2000.

Novel 3-D Video Display Technology Developed [online] [retrieved on Feb. 14, 2003]. Retrieved from the Internet at <URL: www.eurekalert.org>.

SPD [online] [retrieved on Apr. 1, 2004]. Retrieved from the Internet at <URL: www.malvino.com/ep.suspende1.htm>.

Suspended-Particle Devices [online] [retrieved on Apr. 1, 2004]. Retrieved from the Internet a <URL: www.refr-spd.com/article.html>.

Time Multiplexed Optical Shutter (TMOS) [online] [retrieved on Apr. 8, 1999]. Retrieved from the Internet at <URL: www.vea.com/TMOS.html>.

Time Multiplexed Optical Shutter (TMOS) [online] [retrieved on Apr. 5, 2001]. Retrieved from the Internet at <URL: www.tralas.com/TMOS.html>.

What is SPD? [online] [retrieved on Dec. 4, 2002]. Retrieved from the Internet at <URL: www.spd-systems.com/spdq.htm>.

Slot Machine Buyer's Handbook, A Consumer's Guide to Slot Machines written by David L. Saul and Daniel R. Mead, published in 1998.

Slot Machines A Pictorial History of the First 100 Years, 5$^{th}$ edition written by Marshall Fey, published in 1983-1997.

Slot Machines on Parade, 1$^{st}$ edition written by Robert N. Geddes and illustrated by Daniel R. Mead, published in 1980.

Spin-A-Lot Brochure written by Acres Gaming Incorporated, published prior to 2001.

Wheel of Fortune Advertisement written by IGT, published in 1998.

Wheel of Fortune Advertisement written by IGT, published in 1999.

GAMING SYSTEM HAVING DISPLAY DEVICE WITH CHANGEABLE WHEEL

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be). In other words, obtaining a bonus event and a bonus award in the bonus event is part of the enjoyment and excitement for players.

Certain known gaming devices include a display screen in front of a conventional set of reels. In these gaming devices, as the reels spin, the outer surfaces of the reels move closer to and then away from the display screen. In such known gaming devices, it is extremely difficult to provide images which are coordinated with the movement of the outer surfaces of the reels. Each image has to be coordinated with the respective section of the outer surface of the reel as it moves closer to and away from the display screen. This is very time consuming to create or program, and is inefficient to accomplish for a large number of games with different images and different functionality such as in a server based environment.

There is a need to provide further display devices for gaming machines, and in particular, display devices for server based gaming environments.

SUMMARY

The present disclosure provides a gaming device having a housing and a display device supported by the housing, wherein the display device eliminates certain limitations of known single display devices and of game play associated with such single display devices. Various embodiments of the display device disclosed herein include one or more display screens and a mechanical rotatable wheel mounted behind the display screen(s). Each display screen is capable of showing one or more images in coordination with the mechanical wheel. Each display screen is also capable of becoming partially or completely transparent or opaque in one embodiment. The display device is particularly suited for a server based gaming environment as discussed below, where the symbols on the mechanical wheel may need to be different for different games sent by or otherwise caused to be displayed by a central server.

In one embodiment, the mechanical wheel is blank. In another embodiment, the mechanical wheel includes or has only the different slices or outcome sections (i.e., without symbols, or images or color in any of those sections). In other embodiment one, a plurality or all of the sections have or are colored with one or more different colors. The respective display screens are configured to display symbols such as numbers that appear to be on the mechanical wheel or wheel sections or slices. The images displayed by the display screens are synced with the mechanical wheel such that when the mechanical wheel is spinning or rotating, the display screen spins or rotates the images of symbols (such as the numbers) associated with the mechanical wheel or with each section of the mechanical wheel in a manner that each respective symbol (such as each number) remains associated with the same or substantially the same position (such as associated with its respective section or slice) throughout the mechanical wheel's spin.

In various embodiments, the display screen(s) enables the mechanical wheel to be used in a server based gaming environment. This is accomplished by using at least one of the display screens to interact with the mechanical wheel which is behind the display screens. The mechanical wheel is synced with the display screens such that it can be moved or spun at an appropriate speed under control of the gaming machine processor. In one embodiment, the game being played, as determined or provided by the server, determines which symbols are displayed on the wheel. For blank wheels, the game being played, as determined or provided by the server, can also determine how many sections the wheel has and thus cause the display of the determined number of sections and determined number of symbols in association with the mechanical wheel. Any suitable images can be displayed by the display screen to delineate the different sections on the wheel. It should thus be appreciated that the size and number of the sections of the wheel can change for different games or plays of a game. It should also be appreciated that the images are displayed in various embodiments to look like they are on the mechanical wheel. Thus, in various embodiments, the present disclosure provides a changeable wheel partially for bonus games.

Additionally, in various embodiments, the front surface of the wheel is flat or substantially flat. This enables the images to be displayed in conjunction with the wheel without having to account for a changing distance between the outer surface of the wheel and the display screen (i.e., without having to account for portions of the outer surface moving closer to and then further away from the display screen). Thus, while each image has to be coordinated with the respective portions of the outer surface of the wheel as it spins or rotates, this is much less time consuming to create or program, and is much more efficient to accomplish for a large number of games with different images and different functionality such as in a server based environment.

In one embodiment, the display device incorporates actual depth by combining the mechanical wheel with one or more layers of display screens in front of the mechanical wheel. In one embodiment, the display device incorporates depth by combining multiple layers of selectively transparent screens to create true depth while dividing images into separate channels to be respectively displayed by each display screen in conjunction with the mechanical wheel, and particularly with the mechanical wheel as it rotates.

In one embodiment, the display screens are aligned in parallel planes or substantially parallel planes to each other with a pre-set distance between each respective pair of display screens. Each of the distances depends on the level of desired depth related to the display screen sizes. In one alternative embodiment, the display device is configured such that the distance between display screens can be changed or varied to enhance the effect with respect to each other and with respect to the mechanical wheel. In one embodiment, this change is distance can be done prior to the start of a game (or the start of the display of images in association with the mechanical wheel). In one alternative embodiment, this can be done in real time. In one embodiment, images displayed on the display screen furthest from the viewer (i.e., the background display screen) will appear at some depth behind images displayed on the display screen closest to the viewer (i.e., foreground display screen). The transparent portions of the foreground display screen enable viewers to see images displayed on the background display screen. It should be appreciated that additional intermediate layers of the display screens may be added to give greater depth to the display device. It should also be appreciated that additional intermediate layers of the display screens may be added to provide more complex images in association with the mechanical wheel.

It should be appreciated that in various embodiments, at least one indicator is associated with the mechanical wheel to indicate which section or sections are selected. The indicator(s) in different embodiments are physical objects positioned behind the display screen adjacent to the wheel and in alternative embodiments displayed by one or more of the display screens. In the latter embodiments, the size, shape and number of the sections car be easily changed for different games in a server based environment.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION

The present disclosure may be implemented in various configurations for gaming machines, gaming devices or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
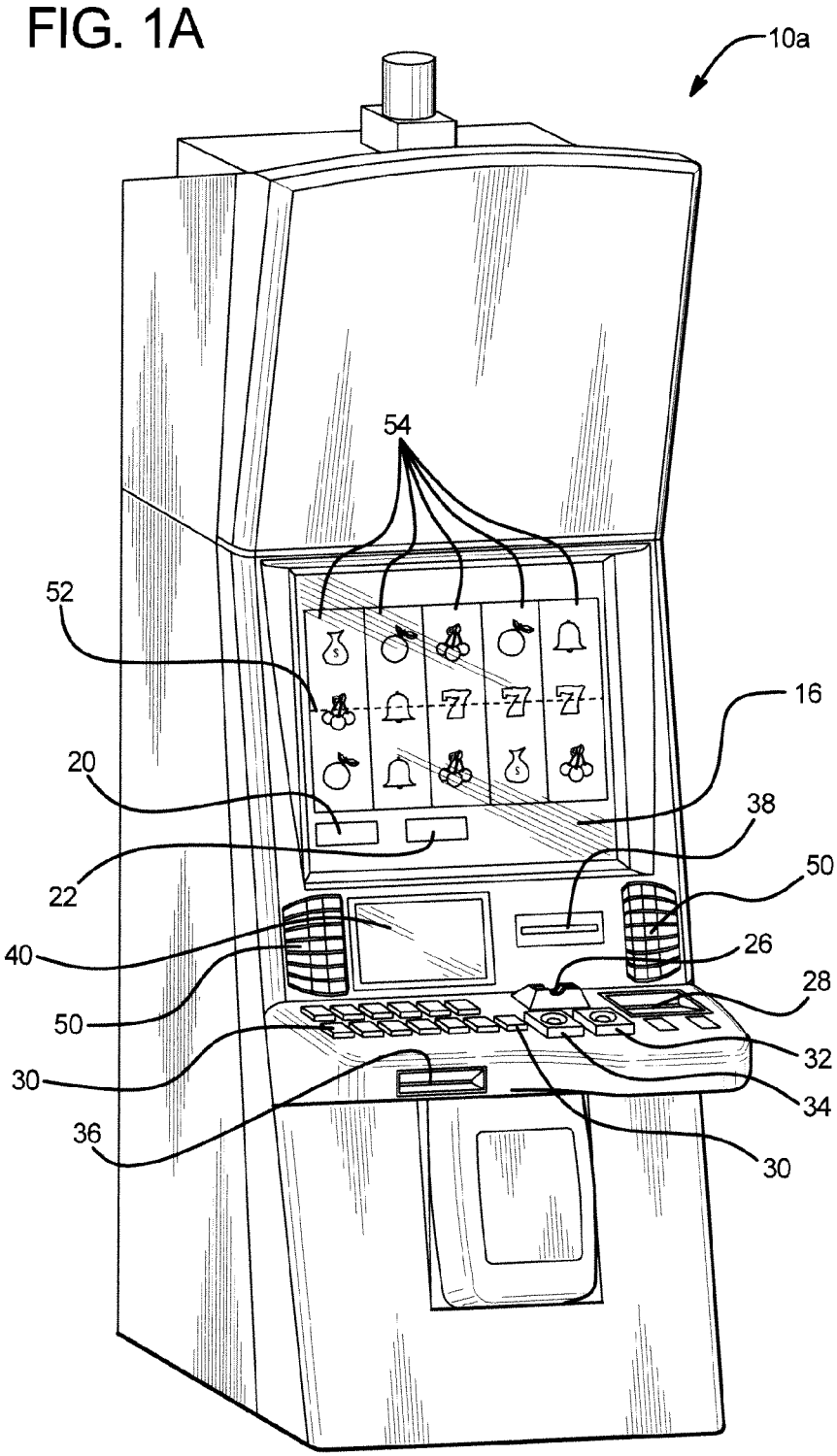
FIG. 1A is a front-side perspective view of one embodiment of the gaming device disclosed herein.
Figure 1B:
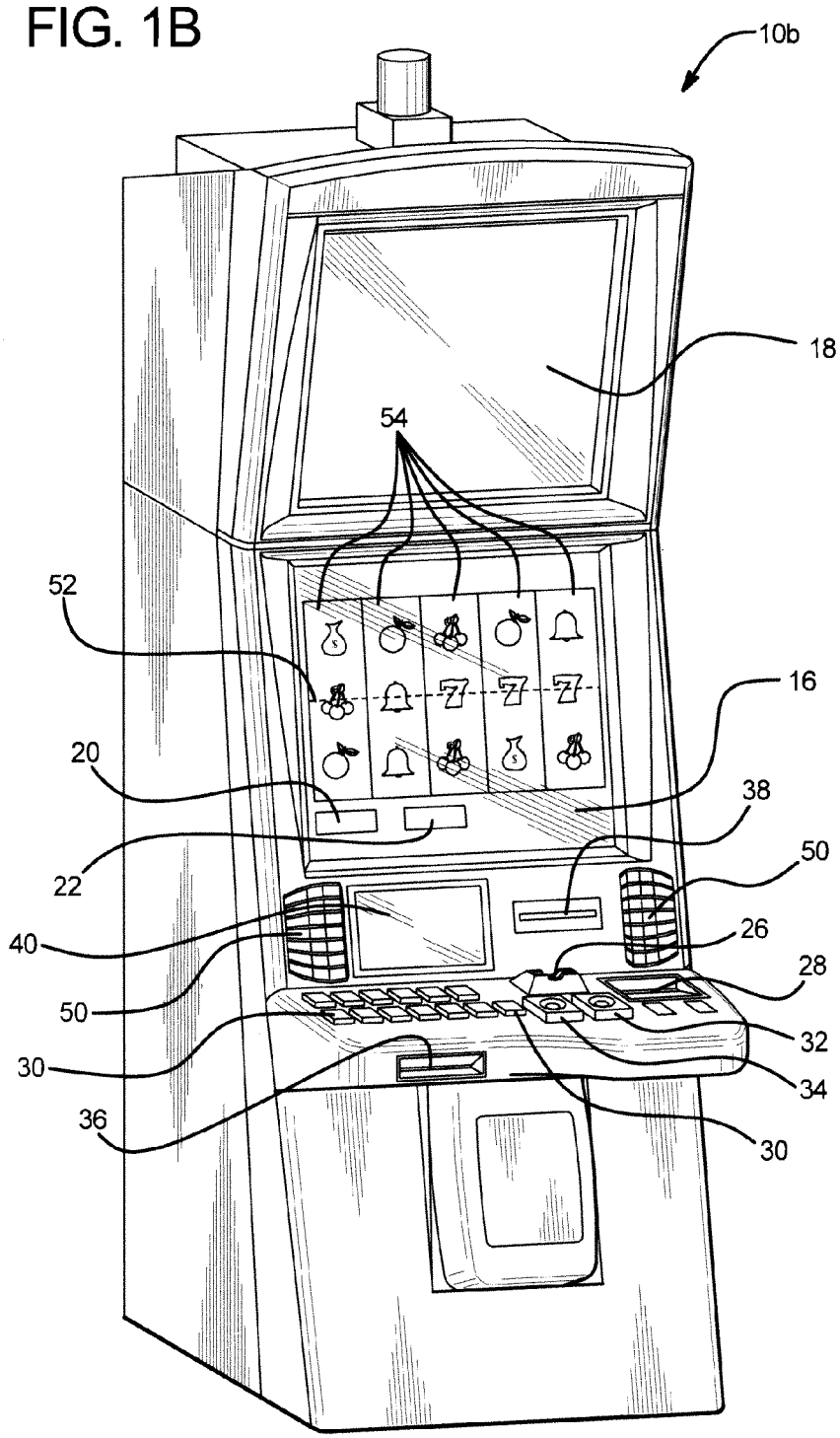
FIG. 1B is a front-side perspective view of another embodiment of the gaming device disclosed herein.

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
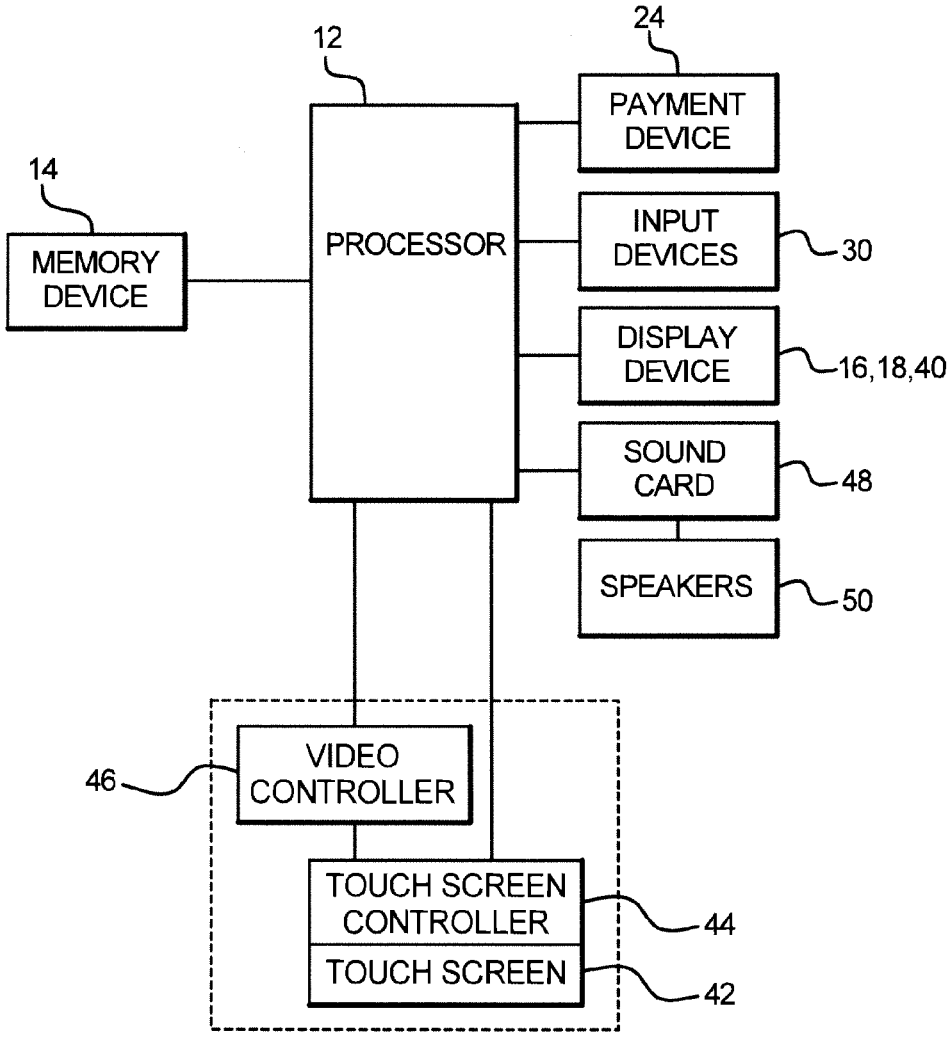
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, the gaming device or gaming machine disclosed herein is operable over a wireless network, such as part of a wireless gaming system. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status. Various other display devices are discussed below.

One or more of the display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
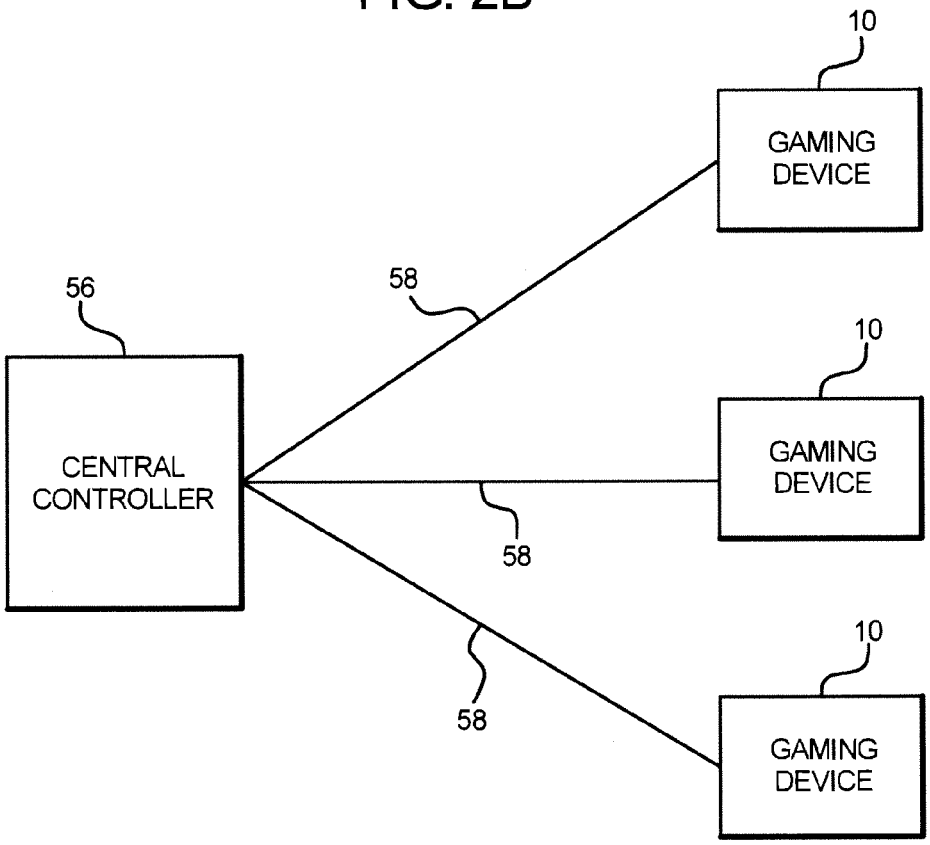
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Display Device

Figure 3:
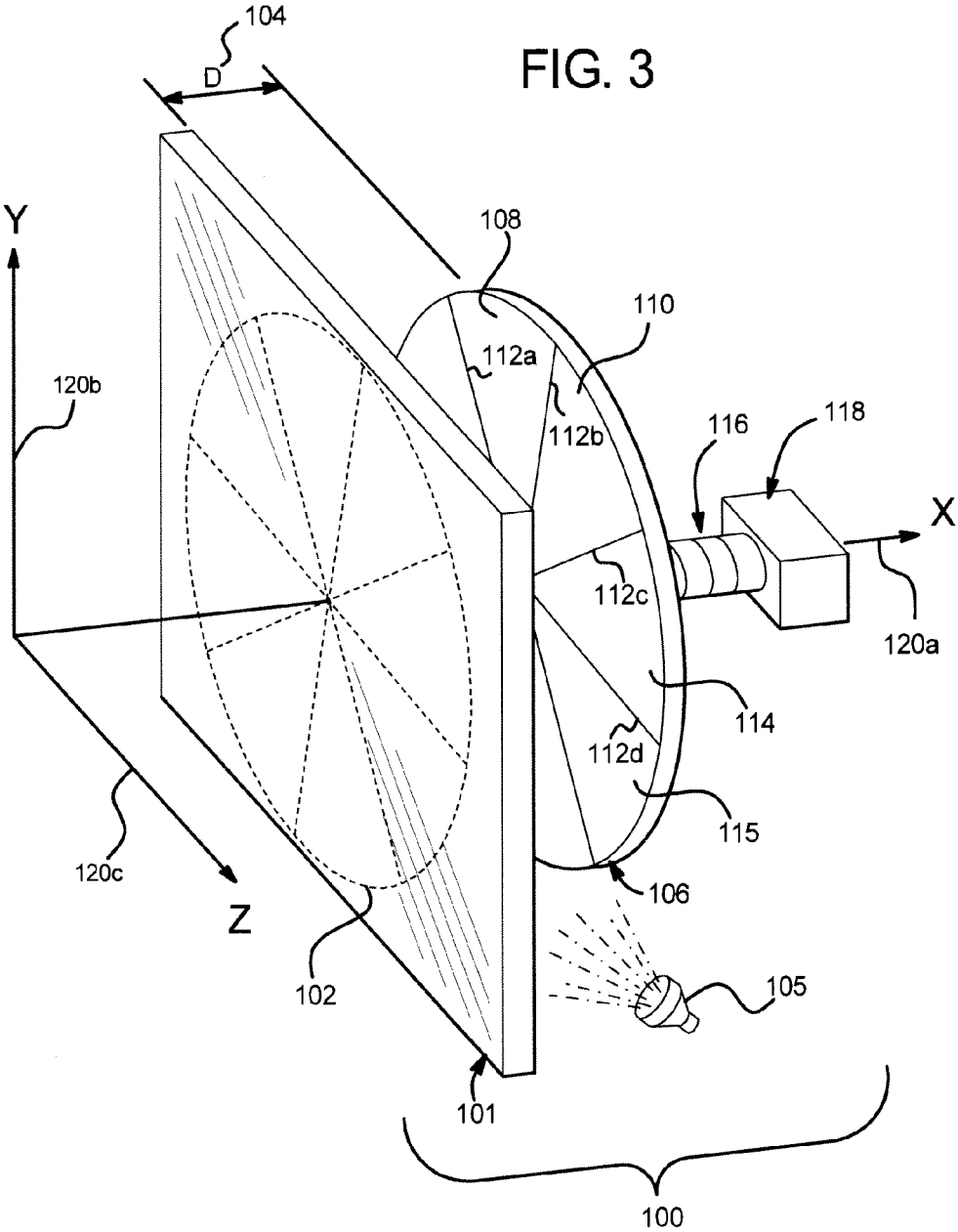
FIG. 3 is an enlarged diagrammatic side perspective view of one embodiment of the display device disclosed herein shown removed from the gaming device cabinet and illustrating a display screen, a mechanical wheel, and a wheel actuator mechanism.

Turning now to FIG. 3, one embodiment of the display device of the present disclosure is illustrated. The gaming device 10 (not shown) includes a display device 100. In one embodiment, gaming device 10 includes a cabinet (not shown) that houses display device 100. Display device 100 is enlarged and illustrated as positioned along axes or planes X 120*a*, Y 120*b*, and Z 120*c*. In the illustrated embodiment, the display device 100 includes a display screen 101, a light source 105, a mechanical wheel 106, a shaft 116, and an actuator 118.

In one embodiment, display screen 101 is a relatively flat and thin touch screen LCD monitor. Display screen 101 can display any number of games and game related information such as game images and actual awards or outcomes. Display screen 101 can also be configured to be fully or partially transparent or opaque. The level of transparency or opacity of display screen 101 depends on the game a player or the gaming machine selects to play. In one embodiment, display screen 101 is substantially transparent and enables a player to view objects positioned behind display screen 101. Image 102 is drawn in phantom to illustrate that an object can be visible behind display screen 101 while display screen 101 is in a partially or substantially transparent state. In another embodiment, display screen 101 can be rendered substantially opaque such that no objects positioned behind display screen 101 are visible. Alternatively in one embodiment, different sections of display screen 101 can be rendered transparent while other sections are rendered opaque. Thus, in one embodiment, display screen 101 is configured to selectively enables a player to view some objects positioned behind display screen 101, while restricting the view of other objects positioned behind display screen 101. The light source 105 can be any suitable light source configured to provide backlighting for the display screen 101. It should also be appreciated that In one embodiment, mechanical wheel 106 is positioned behind display screen 101. Mechanical wheel 106 is positioned a distance D 104 from display screen 101. The distance D 104 between mechanical wheel 106 and display screen 101 can be any suitable distance. In one embodiment, distance D 104 is approximately ½ inch, but it should be appreciated that in alternative embodiments, distance D 104 can be smaller such as 3/16 of an inch such that the mechanical wheel 106 is parallel and almost flush against the back side of display screen 101. The distance D can alternatively be larger than ½ inch. The distance D 104 can be varied before, during, or after game play. In another embodiment, mechanical wheel 106 can be moved in a direction perpendicular to the X axis 120*a*.

In one embodiment, the face of mechanical wheel 106 is blank. In this embodiment, all of the images for the wheel (including the wheel sections 112*a*, 112*b*, 112*c*, 112*d* etc.) are provided by the display screen instead of by the wheel. This enables the sections to be varied for different games and different plays of games. Alternatively, the face of the mechanical wheel 106 has an attached visible design facing in the direction of display screen 101. In one illustrated embodiment, the visible design on mechanical wheel 106 includes a plurality of sections such as sections 108, 110, 114, and 115 created by dividing lines such as dividing lines 112*a*, 112*b*,

112*c*, and 112*d*. In one embodiment, dividing lines 112*a* to 112*d* are created by attaching wires to mechanical wheel 106. Alternatively, dividing lines 112*a* to 112*d* can be created on mechanical wheel 106 by printing, embossing, engraving, or any other suitable manner for creating a visible design on mechanical wheel 106. In other alternative embodiments, any design suitable for any game can be placed on mechanical wheel 106 in any suitable manner.

In one embodiment, shaft 116 is coupled to the rear of mechanical wheel 106. Shaft 116 can be welded, bolted, or otherwise coupled to the rear of mechanical wheel 106 in any suitable manner. In one embodiment, shaft 116 is a substantially cylindrical steel rod that enables a rotating force to be applied to mechanical wheel 106 in order to rotate mechanical wheel 106 in either a clockwise or counter clockwise direction or alternatively in a direction perpendicular to X axis 120*a*. Shaft 116 can alternatively be formed in any suitable shape and from any suitably strong material.

In one embodiment, shaft 116 is also coupled to actuator 118. Actuator 118 is coupled to shaft 116 in any suitable manner. Actuator 118 includes a suitable motor capable of driving/rotating shaft 116 and mechanical wheel 106. In one embodiment, actuator 118 is configured to rotate shaft 116 in either a clockwise or counter clockwise direction about the X axis 120*a*. In a further alternative embodiment, actuator 18 is configured to move shaft 116 along the X axis 120*a* toward and away from the display screen 101. Other suitable mechanisms for increasing and decreasing the distance between the mechanical wheel and the display screen(s) may be employed. Although not shown, it should be appreciated that one or more sensors such as optical sensors can be employed to verify the location or position of the wheel as it rotates or spins and when it stops.

Figure 4A:
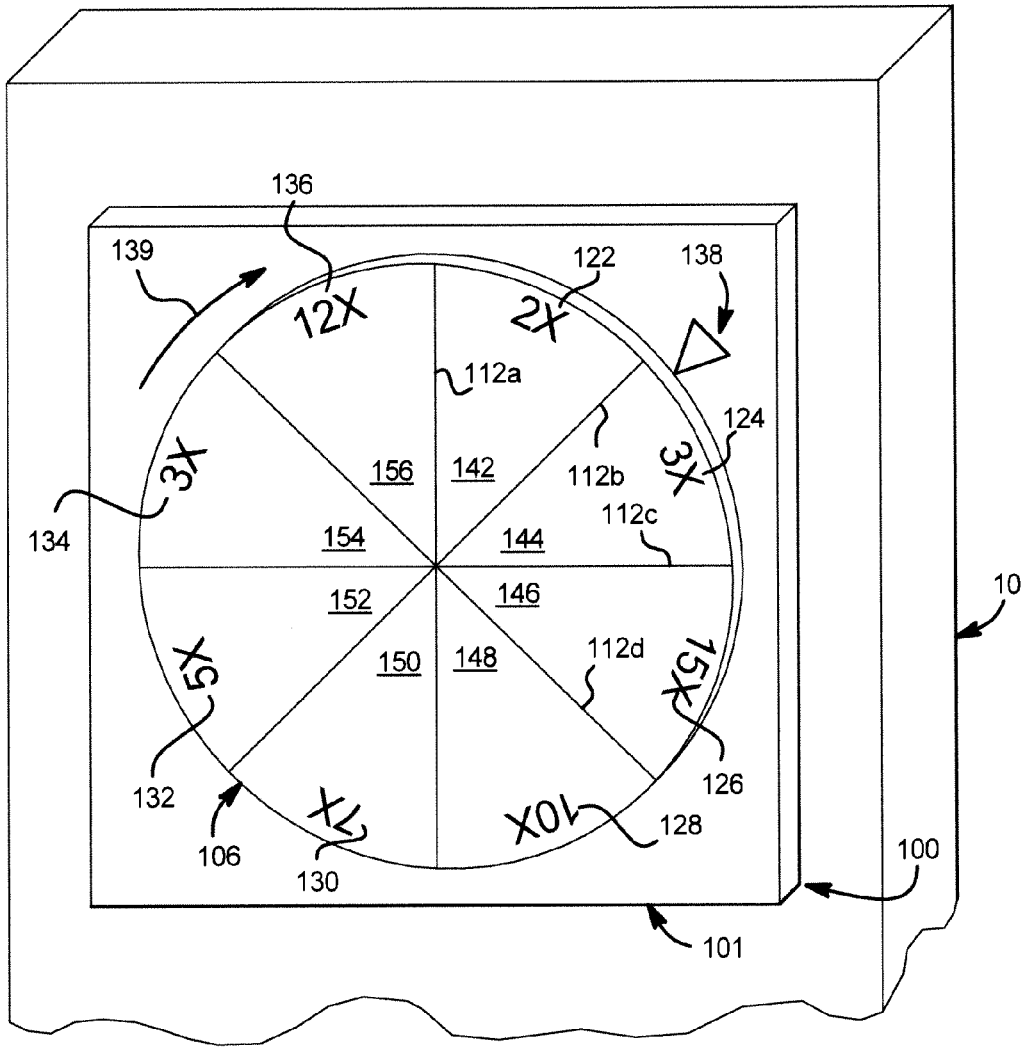
FIGS. 4A and 4B are diagrammatic fragmentary elevation views of one embodiment of the gaming device disclosed herein illustrating award multipliers displayed by a display screen and that are synchronized with a mechanical wheel positioned behind the display screen.
Figure 4B:
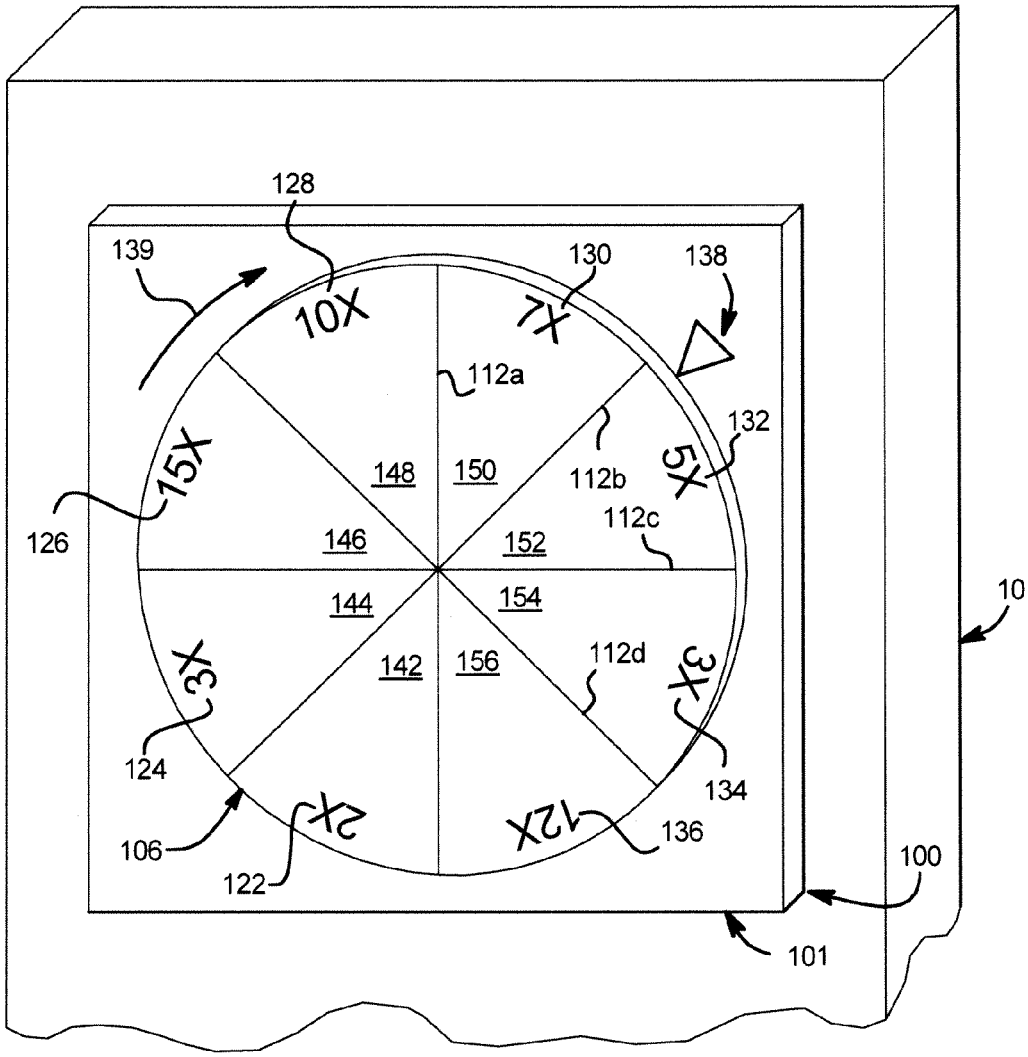

As illustrated in FIGS. 4A and 4B, the gaming device includes a display device 100 including a display screen 101 and a mechanical wheel 106 that interact to create a unified bonus game display. In various embodiments, it should be appreciated that a base game which can be any suitable base game such as a video reel game is displayed by the display screen and a bonus game includes the wheel. In certain embodiments, a trigger in a base game causes the wheel to be visible through the display screen.

In the illustrated embodiment, display screen 101 is in a substantially transparent condition except for the displayed images. Display screen 101 is configured to enable a player to view the mechanical wheel 106 that is situated behind display screen 101. Display screen 101 displays a plurality of game images such as award multipliers 122, 124, 126, 128, 130, 132, 134, and 136 as well as an award multiplier indicator 138.

The mechanical wheel 106 is positioned behind and is substantially aligned behind in a parallel plane to display screen 101. Dividing lines 112*a* to 112*d* are provided for the mechanical wheel 106 in any suitable manner as described above. Dividing lines 112*a* to 112*d* form eight sections 142, 144, 146, 148, 150, 152, 154, and 156 for the mechanical wheel 106. It should be appreciated that because the wheel and the screen are substantially aligned, the images displayed by the display screens do not need to be distorted to conform to a curvature of a reel. This provides a significant advantage as discussed above in part because the images do not need be continuously changing formation or configuration while they are rotating in association with the wheel.

Together, these images on display screen 101 and the sections 142, 144, 146, 148, 150, 152, 154, and 156 for the mechanical wheel 106 form the basis of the unified game image on display device 100. It should be appreciated that for different games, one, a plurality or all of the display images will be different. In one illustrated embodiment, the gaming machine or the player cause the actuation of the mechanical wheel 106 to begin rotating in the clockwise direction as indicated by direction arrow 139. When mechanical wheel 106 rotates in the clockwise direction, sections 142, 144, 146, 148, 150, 152, 154, and 156 (connected to mechanical wheel 106) rotate in the clockwise direction with mechanical wheel 106. Displayed award multipliers 122, 124, 126, 128, 130, 132, 134, and 136 also rotate in sync with sections 142, 144, 146, 148, 150, 152, 154, and 156 of the mechanical wheel 106. For example, as section 152 on mechanical wheel 106 rotates clockwise, the 5× award multiplier 132 displayed on display screen 101 will visibly rotate clockwise in substantial synchronization with section 152. Thus, the 5× award multiplier 132 will appear to be connected or linked to section 152 of mechanical wheel 106. Similarly, each award multiplier and each associated section visibly rotate in substantial synchronization with each other.

When mechanical wheel 106 stops rotating, each of the award multipliers 122, 124, 126, 128, 130, 132, 134, and 136 also stop rotating as illustrated in FIG. 4B. The gaming device provides the player with an award indicated by award indicator 138 when mechanical wheel 106 and award multipliers 122, 124, 126, 128, 130, 132, 134, and 136 stop rotating. In the embodiment illustrated in FIG. 4B, section 152 and the associated 5× award multiplier 132 stopped at award indicator 138. Thus, the gaming device provides the player a 5× award multiplier.

Figure 4C:
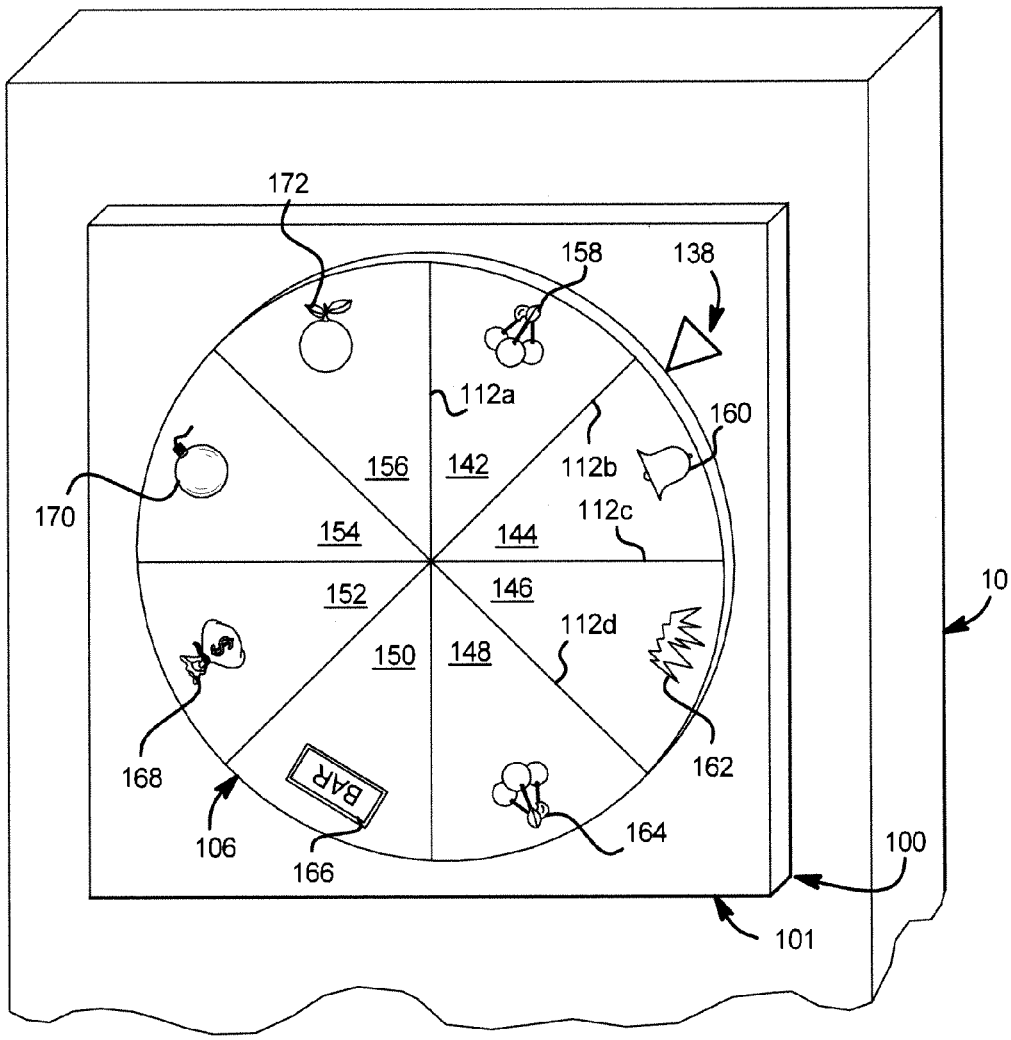
FIG. 4C is a diagrammatic fragmentary elevation view of one embodiment of the gaming device disclosed herein illustrating award symbols displayed by a display screen and that are synchronized with a mechanical wheel positioned behind the display screen.

In the embodiment illustrated in FIG. 4C, the images on display screen 101 are symbols. Display screen 101 is substantially transparent as with FIGS. 4A and 4B. Display screen 101 is configured to enable a player to view mechanical wheel 106 that is situated behind display screen 101. Display screen 101 displays a plurality of game images including award symbols 158, 160, 162, 164, 166, 168, 170, and 172, as well as an award indicator 138 in association with the underlying mechanical wheel 106. Mechanical wheel 106 is positioned behind and is substantially aligned with and in a parallel plane to display screen 101. Dividing lines 112*a* to 112*d* are overlaid on top of mechanical wheel 106 in a manner described above. Dividing lines 112*a* to 112*d* form eight sections 142, 144, 146, 148, 150, 152, 154, and 156 on mechanical wheel 106.

Like the embodiments described in connection with FIGS. 4A and 4B, award symbols 158, 160, 162, 164, 166, 168, 170, and 172 are associated with sections 142, 144, 146, 148, 150, 152, 154, and 156 respectively. When the sections rotate with mechanical wheel 106, award symbols 158, 160, 162, 164, 166, 168, 170, and 172 rotate substantially synchronized with each associated section. Thus, the award symbols appear to be linked or connected to the respective associated sections of mechanical wheel 106. In the illustrated embodiment, mechanical wheel 106 and award symbols stopped rotating. Award indicator 138 indicates that the player won an award associated with the bell award symbol 160 and section 144 of mechanical wheel 106. The gaming device provides the player a predetermined award associated with the bell award symbol 160. In an alternative embodiment, the gaming device will randomly select and associate an award value to the bell award symbol 160 before, during, or after award indicator 138 indicates the award. It should be appreciated that other awards and other suitable methods of determining and providing the awards may be employed.

Figure 4D:
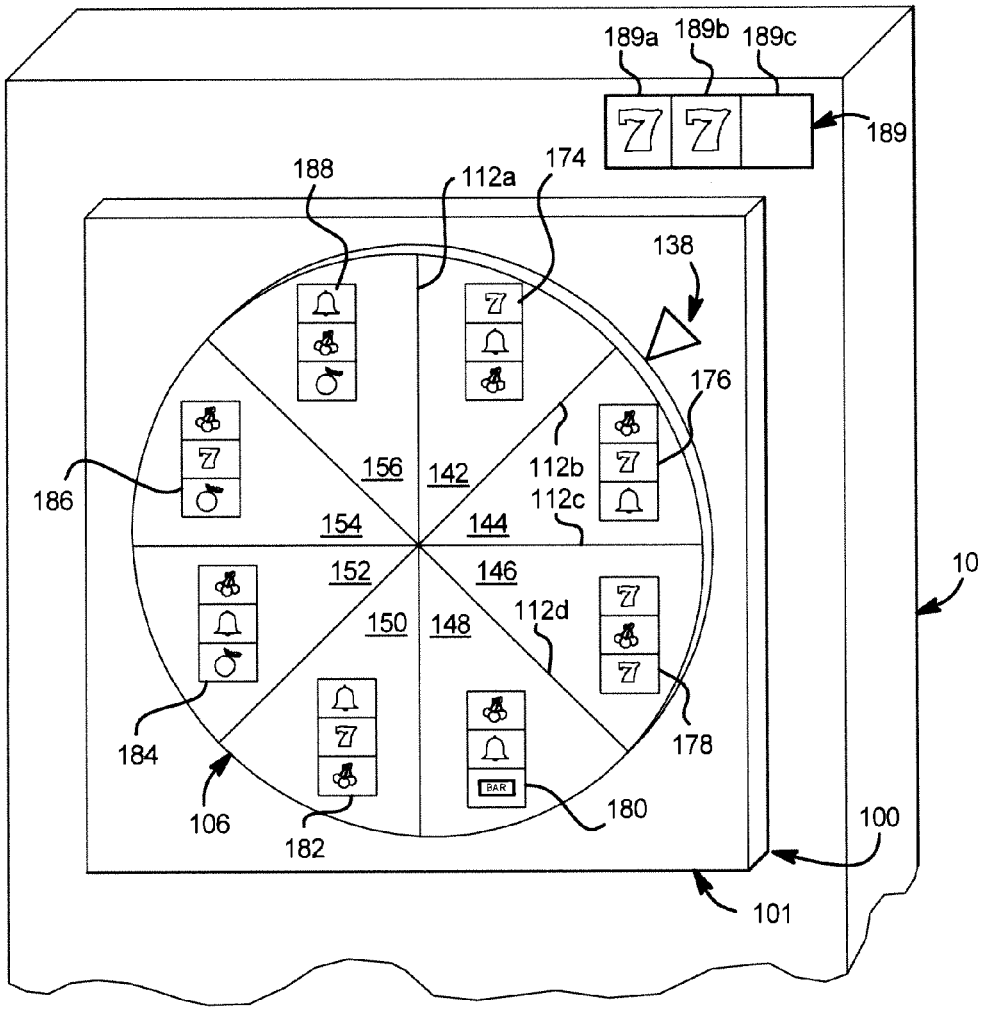
FIG. 4D is a diagrammatic fragmentary elevation view of one embodiment of the gaming device disclosed herein illustrating video reels displayed by a display screen and that are synchronized with a mechanical wheel positioned behind the display screen.

In the alternative embodiment illustrated in FIG. 4D, the images displayed by display screen 101 are video reels. Display screen 101 is otherwise substantially transparent as with the previous embodiments. Display screen 101 is configured to enable a player to view mechanical wheel 106 that is situated behind display screen 101. Display screen 101 displays a plurality of game images including individual video reels 174, 176, 178, 180, 182, 184, 186, and 188, an award indicator 138, and a payline indicator 189.

Mechanical wheel 106 is positioned behind and is substantially parallel to display screen 101. Dividing lines 112*a* to 112*d* are overlaid on top of mechanical wheel 106 in a manner described above. Dividing lines 112*a* to 112*d* form eight sections 142, 144, 146, 148, 150, 152, 154, and 156 on mechanical wheel 106.

Like the embodiments described in connection with FIGS. 4A to 4C, video reels 174, 176, 178, 180, 182, 184, 186, and 188 are associated with sections 142, 144, 146, 148, 150, 152, 154, and 156 respectively. When the sections rotate with mechanical wheel 106, video reels 174, 176, 178, 180, 182, 184, 186, and 188 rotate substantially synchronized with each associated section. Thus, the video reels appear to be linked or connected to the associated sections of mechanical wheel 106. In one embodiment, the video reels each remain upright when the mechanical wheel rotates. In another embodiment, the video reels are displayed in a more pre-set position with respect to each section for the mechanical wheel such that video reels may not be upright as the mechanical wheel spins.

The mechanical wheel and the video reels may interact and rotate with respect to each other in any suitable manner. For instance, in one embodiment, the mechanical wheel 106 and video reels 174, 176, 178, 180, 182, 184, 186, and 188 each rotate together or simultaneously (i.e., the wheel spins while the video reels each rotate). In one such embodiment, the video reels stop rotating when the mechanical wheel 106 and video reels stop rotating. In other embodiments, one of the mechanical wheel and one or more of the video reels can stop rotating before or start rotating after the other. In other embodiments, the rotations can be partially overlapping.

It should be appreciated that any suitable video reel game can be employed with the video reels on the mechanical wheel. In the embodiment illustrated in FIG. 4D, multiple spins of the mechanical wheel are employed to select the symbols. In one such embodiment, the gaming device enables a player to actuate at least three spins in the game of the present embodiment. When award indicator 138 indicates a particular video reel, the symbol in the center of the video reel is selected as a winning symbol and placed in payline indicator 189. In the illustrated embodiment, the player already obtained two 7 symbols as indicated in payline indicator 189*a* and 189*b*. On the player's third spin, mechanical wheel 106 and video reels stopped rotating and symbols stopped rotating through the video reels. Award indicator 138 indicates that a third 7 has been selected for the player's payline indicator 189*c*. The gaming device provides the player a predetermined award associated with forming three 7 symbols in payline indicator 189. In alternative embodiments, the gaming device provides a player with one or more spins of the mechanical wheel to collect a set of award symbols in payline indicator 189 that are associated with a payout. The gaming device can adjust the size of payline indicator 189 based on the number of spins provided to the player.

Figure 4E:
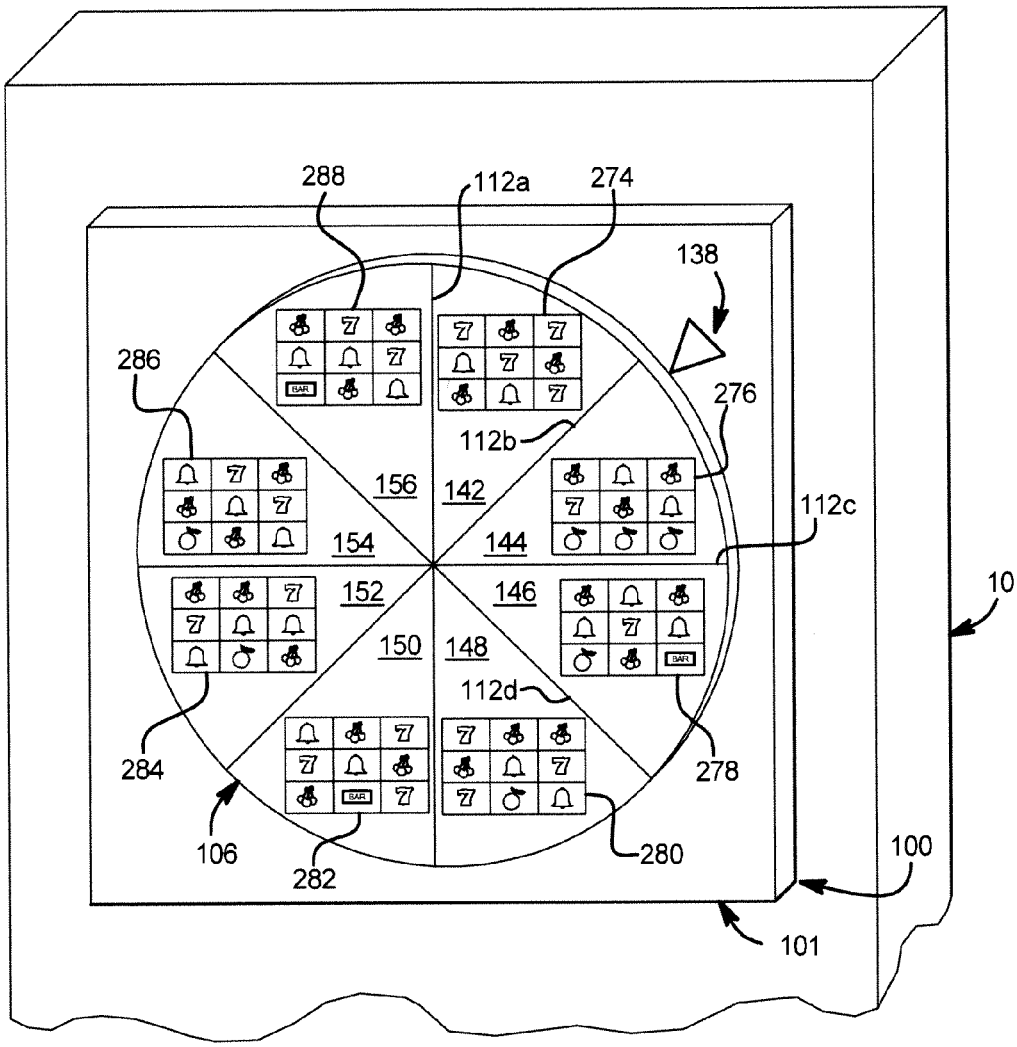
FIG. 4E is a diagrammatic fragmentary elevation view of one embodiment of the gaming device disclosed herein illustrating sets of video reels displayed by a display screen and that are synchronized with a mechanical wheel positioned behind the display screen.

In a further alternative embodiment illustrated in FIG. 4E, the images displayed by display screen 101 are sets of video reels. Display screen 101 is otherwise substantially transparent as with the previous embodiments. Display screen 101 is configured to enable a player to view mechanical wheel 106 that is situated behind display screen 101. Display screen 101 displays a plurality of game images including sets of video reels 274, 276, 278, 280, 282, 284, 286, and 288, and an indicator 138. The sets of video reels 274, 276, 278, 280, 282, 284, 286, and 288 are associated with sections 142, 144, 146, 148, 150, 152, 154, and 156 respectively. When the sections rotate with mechanical wheel 106, the sets of video reels 274, 276, 278, 280, 282, 284, 286, and 288 rotate substantially synchronized with each associated section. Thus, the sets of video reels appear to be linked or connected to the associated sections of mechanical wheel 106. In one embodiment, the sets of video reels each remain upright when the mechanical wheel rotates. In another embodiment, the sets of video reels are displayed in a more pre-set position with respect to each section for the mechanical wheel such that video reels may not be upright as the mechanical wheel spins. The mechanical wheel and the sets of video reels may interact and rotate with respect to each other in any suitable manner. It should be appreciated that any suitable video reel game can be employed with the sets of video reels on the mechanical wheel.

Figure 4F:
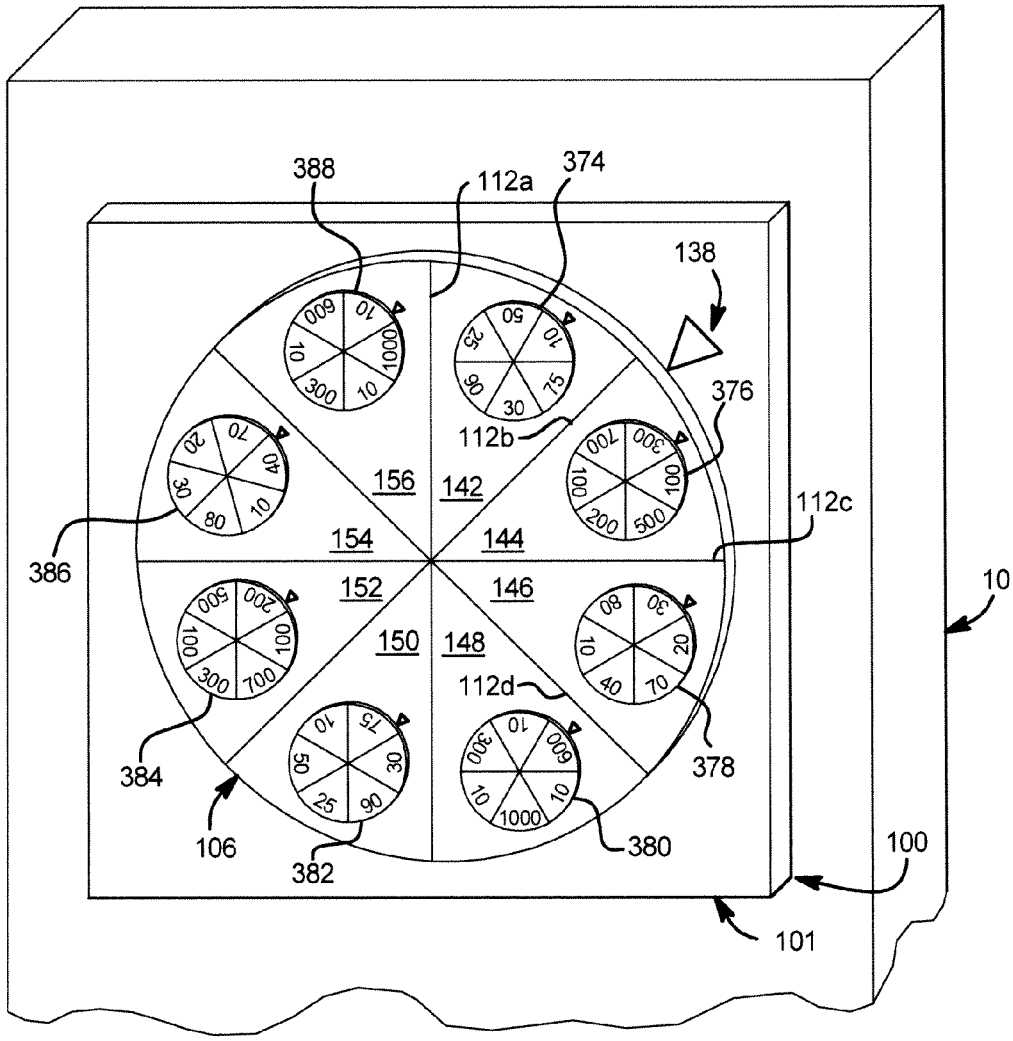
FIG. 4F is a diagrammatic fragmentary elevation view of one embodiment of the gaming device disclosed herein illustrating video wheels displayed by a display screen and that are synchronized with a mechanical wheel positioned behind the display screen.

In a further alternative embodiment illustrated in FIG. 4F, the images displayed by display screen 101 are video wheels. Display screen 101 is otherwise substantially transparent as with the previous embodiments. Display screen 101 is configured to enable a player to view mechanical wheel 106 that is situated behind display screen 101. Display screen 101 displays a plurality of game images including video wheels 374, 376, 378, 380, 382, 384, 386, and 388, and an indicator 138. The video wheels 374, 376, 378, 380, 382, 384, 386, and 388 are associated with sections 142, 144, 146, 148, 150, 152, 154, and 156 respectively. When the sections rotate with mechanical wheel 106, the video wheels 374, 376, 378, 380, 382, 384, 386, and 388 rotate substantially synchronized with each associated section. Thus, the video wheels appear to be linked or connected to the associated sections of mechanical wheel 106. In one embodiment, the video wheels each remain upright when the mechanical wheel rotates. In another embodiment, the video wheels are displayed in a more pre-set position with respect to each section for the mechanical wheel such that video wheels may not be upright as the mechanical wheel spins. The mechanical wheel and the video wheels may interact and rotate with respect to each other in any suitable manner. It should be appreciated that any suitable video wheel game can be employed with the video wheels on the mechanical wheel. It should thus be appreciated that other game functional images may be employed in association with one or more sections for the mechanical wheel.

Figure 5:
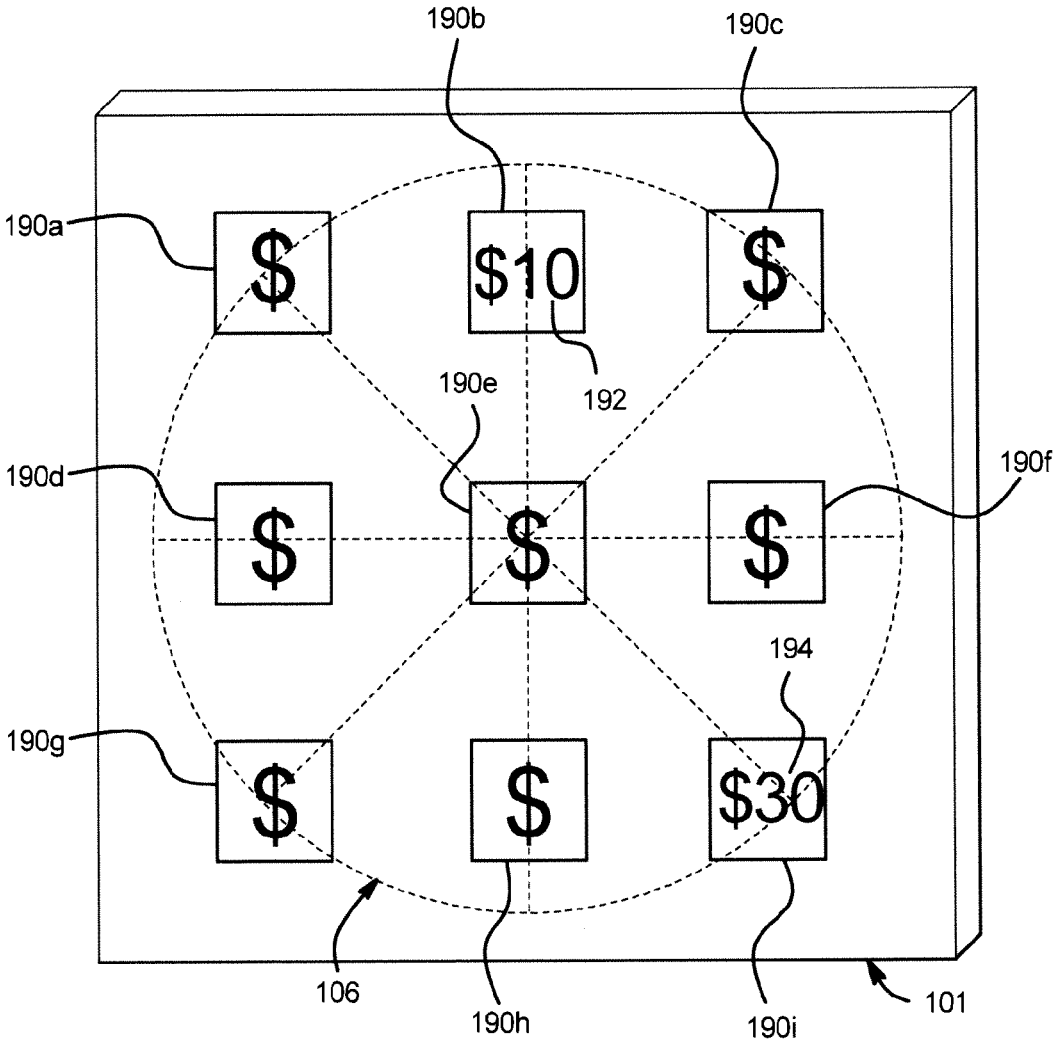
FIG. 5 is a diagrammatic enlarged elevation view of one embodiment of the display device disclosed herein illustrating an offer and acceptance game displayed by a display screen while obstructing the view of a mechanical wheel positioned behind the display screen.

In the embodiment illustrated in FIG. 5, the images on display screen 101 are part of an offer and acceptance game including player selection areas. Display screen 101 is substantially opaque. Display screen 101 is configured to restrict a player's view of mechanical wheel 106 that is situated behind display screen 101. Display screen 101 displays a plurality of game images including player selection areas 190*a* to 190*i*. In this embodiment, the mechanical wheel 106 is still positioned behind the display screen 101. The mechanical wheel 106 is illustrated in phantom in this embodiment. The mechanical wheel 106 is hidden because the mechanical wheel is not necessary to display an offer and acceptance game. Alternatively, display screen 101 can be configured with different levels of opacity to enable the mechanical wheel 106 to be visible in whole or in part to the player if a particular game calls for the mechanical wheel 106 to be visible.

The offer and acceptance game in one embodiment provides a player with a 3×3 selection matrix including selection areas 190*a* to 190*i*. The gaming machine enables the player to select and reveal one or more hidden award offers. Hidden award offers are masked by the dollar sign symbol covering selection areas 190*a* to 190*i*. Revealed awards can be marked with the actual award value as illustrated by the $10 award 192 and the $30 award 194. For example, the player selected and the gaming device revealed a first award 192. The player rejected the first award 192 and subsequently selected and revealed second award 194. After the player accepts the second award 194, the gaming device provides the $30 award 194 to the player and the game ends. During the offer and acceptance game, the display screen 101 remains substantially opaque and only the offer and acceptance game is visible to the player.

Figure 6A:
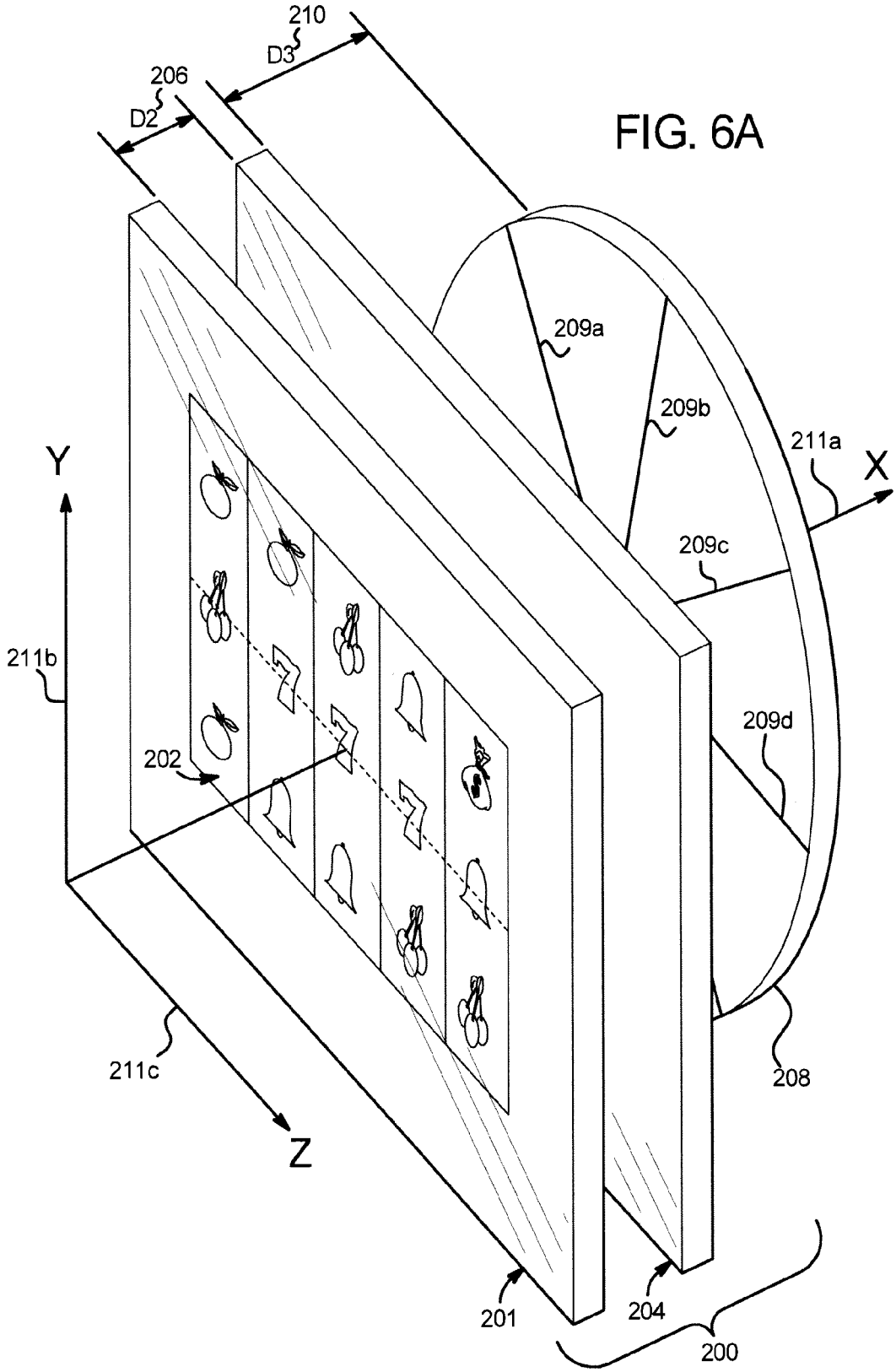
FIG. 6A is an enlarged diagrammatic side perspective view of one embodiment of the display device disclosed herein shown removed from the gaming device cabinet and illustrating two display screens and a mechanical wheel.

Turning now to FIG. 6A, another embodiment of the gaming device of the present disclosure is illustrated. The gaming device includes a display device 200. In one embodiment, the gaming device includes a cabinet (not shown) that houses the display device 200. Display device 200 is enlarged and illustrated as comprising a first display screen 201, a second display screen 204, and a mechanical wheel 208.

In one embodiment, first display screen 201 is a relatively flat and thin touch screen LCD monitor. First display screen 201 is configured to display any suitable number of games and suitable game related information such as game images and actual awards or outcomes. First display screen 201 is also configured to be transparent or opaque at certain times. The level of transparency or opacity in first display screen 201 depends on the game a player or the gaming device selects to play. In the illustrated embodiment, the first display screen 201 displays a traditional video reel game 202 having a payline.

Second display screen 204 is also a relatively flat and thin touch screen LCD monitor. Second display screen 204 is positioned a distance D 206 from first display screen 201. The distance D 206 between second display screen 204 and first display screen 201 can be any suitable distance. In one embodiment, distance D 206 is approximately ½ inch, but can be smaller or larger. In another alternative embodiment, distance D 206 can be varied by moving second display screen 204 in a direction along the X axis 211*a*, or shifting second display screen 204 about the Y axis 211*b* or the Z axis 211*c*. It should be appreciated that second display screen 204 can be moved/shifted before, during, or after game play has begun.

The second display screen 204 can also display any number of games and game related information such as game images and actual awards or outcomes like first display screen 201. Like first display screen 201, the second display screen 204 can also be configured to be transparent or opaque. The level of transparency or opacity in second display screen 204 depends on the game a player or the gaming device selects to play. Additionally, first and second display screen 201 and 204 can be separately controlled such that one display screen can be opaque while the other display screen can be transparent. In the illustrated embodiment, both first and second display screens 201 and 204 are opaque. However, in an alternative embodiment, first and second display screens 201 and 204 can be substantially transparent at designated times and thus enable a player to view objects positioned behind both display screens. In one embodiment, different sections of first display screen 201 and second display screen 204 can be rendered transparent while other sections are rendered opaque at certain times. Thus, in one embodiment, first display screen 201 and second display screen 204 selectively enables a player to view some objects positioned behind the display screens, while blocking the view of other objects positioned behind the display screens.

In one embodiment, the mechanical wheel 208 is positioned behind display screen 204. Mechanical wheel 208 is positioned a distance D 210 from display screen 204. The distance D 210 between mechanical wheel 208 and display screen 204 can be any suitable distance. In one embodiment, distance D 210 is approximately ½ inch, but can be smaller or larger. In another alternative embodiment, distance D 210 can be varied by moving mechanical wheel 208 in a direction along the X axis 211*a*, or shifting mechanical wheel 208 about the Y axis 211*b* or the Z axis 211*c*. If should be appreciated that the mechanical wheel 208 can be moved/shifted before, during, or after game play has begun. It should be appreciated that any suitable mechanism may be employed to shift or change the positions of these components of the display device. Additionally, the mechanical wheel 208 can be configured with any visible design as described above with respect to FIG. 3.

In another alternative embodiment, when the mechanical wheel 208 is moved toward and away from to the first and second display screens 201 and 204 any symbols displayed on first display screen 201 can be modified to enlarge or shrink depending on the distance of the mechanical wheel 208 from the first screen 201. In another embodiment, a realistic 3-dimensional effect can be achieved by moving the symbols displayed in first display screen 201 to the second screen 204 as the mechanical wheel 208 is moved away from the first and second display screens 201 and 204. Likewise, as the mechanical wheel 208 is moved closer to first and second display screens 201 and 204, the symbols displayed can be moved from second display screen 204 to first display screen 201.

In the example embodiment illustrated in FIG. 6A, a first game incorporating traditional video spinning reel game 202 is displayed. The spinning reel game 202 does not incorporate second screen 204 or mechanical wheel 208 for any features; thus, the first display screen 201 is rendered opaque and only the spinning reel game 202 is visible to the player. To ensure the player is not distracted by mechanical wheel 208 during the spinning reel game 202, second display screen 204 can also be rendered opaque. In one embodiment, a secondary game is activated when the spinning reel game displays a row of triple sevens as shown in spinning reel game 202. Alternatively, if no mechanical wheel is required by the secondary game, the first display screen can be kept opaque and the first display screen can show another type of bonus game, thus continuing to hide the mechanical wheel and providing the designer with an even higher level of flexibility in bonusing.

Figure 6B:
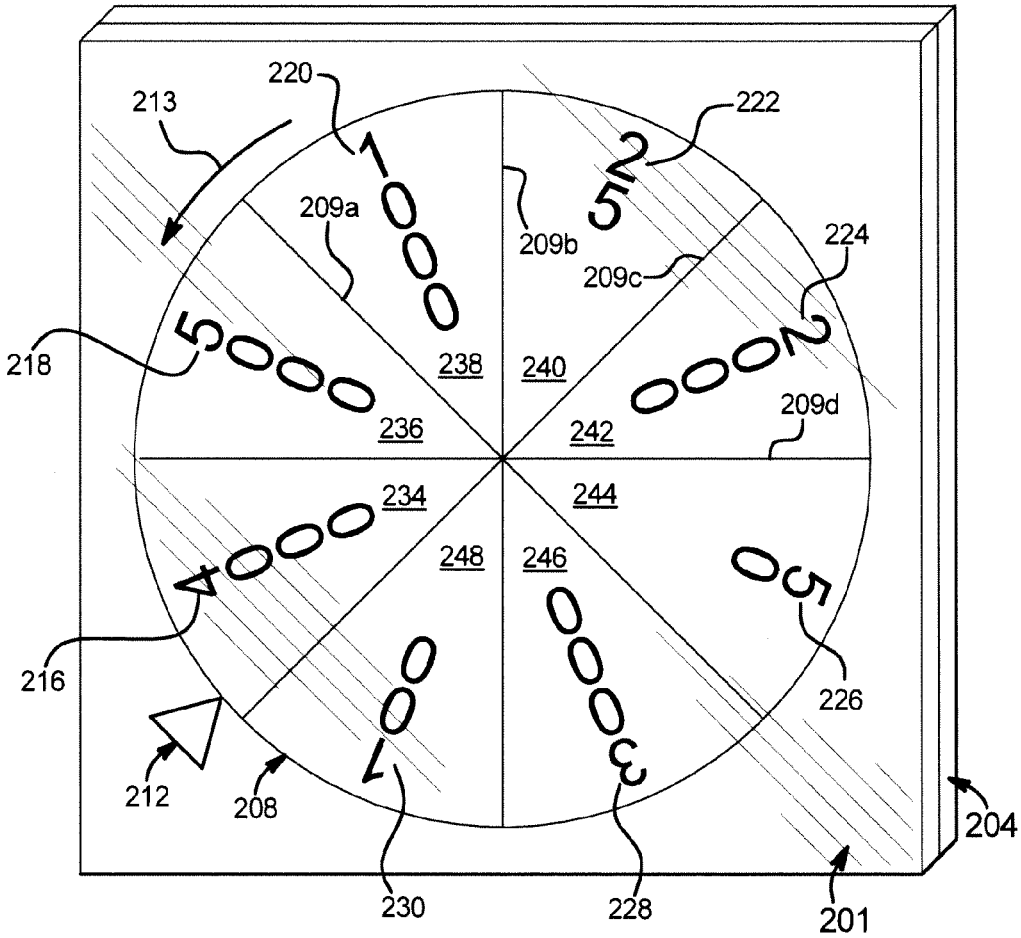
FIG. 6B is an enlarged diagrammatic elevation view of one embodiment of the display device disclosed herein shown removed from the gaming device cabinet illustrating the first and second display screens of FIG. 6A operating together to create a unified game image.

In the embodiment illustrated in FIG. 6B, the secondary game is activated and the spinning reel game 202 is removed from the display. Both the first display screen 201 and the second display screen 204 are rendered substantially transparent. With both the first display screen 201 and the second display screen 204 substantially transparent, mechanical wheel 208 becomes visible to the player for the secondary game. In the illustrated embodiment, the awards 216, 218, 220, 222, 224, 226, 228, and 230 and award indicator 212 are displayed on second display screen 204. Awards 216, 218, 220, 222, 224, 226, 228, and 230 can also be displayed in a diagonal format as illustrated.

The mechanical wheel 208 is positioned behind the second display screen 204. Dividing lines 209*a* to 209*d* are overlaid on top of mechanical wheel 208 in a manner described above. Dividing lines 209*a* to 209*d* form eight sections 234, 236, 238, 240, 242, 244, 246, and 248 on mechanical wheel 208.

Together, the awards and the award indicator on display screen 204 and the sections 234, 236, 238, 240, 242, 244, 246, and 248 on mechanical wheel 208 form the basis of the unified game image on display device 200. In one illustrated embodiment, the gaming machine or the player will cause actuation of the mechanical wheel 208 to begin rotating it in the counter clockwise direction as indicated by direction arrow 213. When mechanical wheel 208 rotates in the counter clockwise direction, sections 234, 236, 238, 240, 242, 244, 246, and 248 (connected to mechanical wheel 208) rotate in the counter clockwise direction with mechanical wheel 208. Additionally, displayed awards 216, 218, 220, 222, 224, 226, 228, and 230 also rotate in sync with sections 234, 236, 238, 240, 242, 244, 246, and 248 of the mechanical wheel 208.

For example, as section 234 on mechanical wheel 208 rotates counter clockwise, the 4000 award 216 displayed on second display screen 204 will visibly rotate counter clockwise in substantial synchronization with section 234. Thus, the 4000 award 216 will appear to be connected or linked to section 234 of mechanical wheel 208. Similarly, each award and each section visibly rotates substantially in sync with each other. The gaming device provides the player with an award indicated by award indicator 212 when mechanical wheel 208 and awards 216, 218, 220, 222, 224, 226, 228, and 230 stop rotating. In the embodiment illustrated in FIG. 6B, section 234 and the associated 4000 award 216 stopped at award indicator 212. Thus, the gaming device provides the player a 4000 credit award. When the bonus game is complete, the first display device becomes opaque again and the player can play further primary games while the second display device and the mechanical wheel remain hidden from view.

Figure 6C:
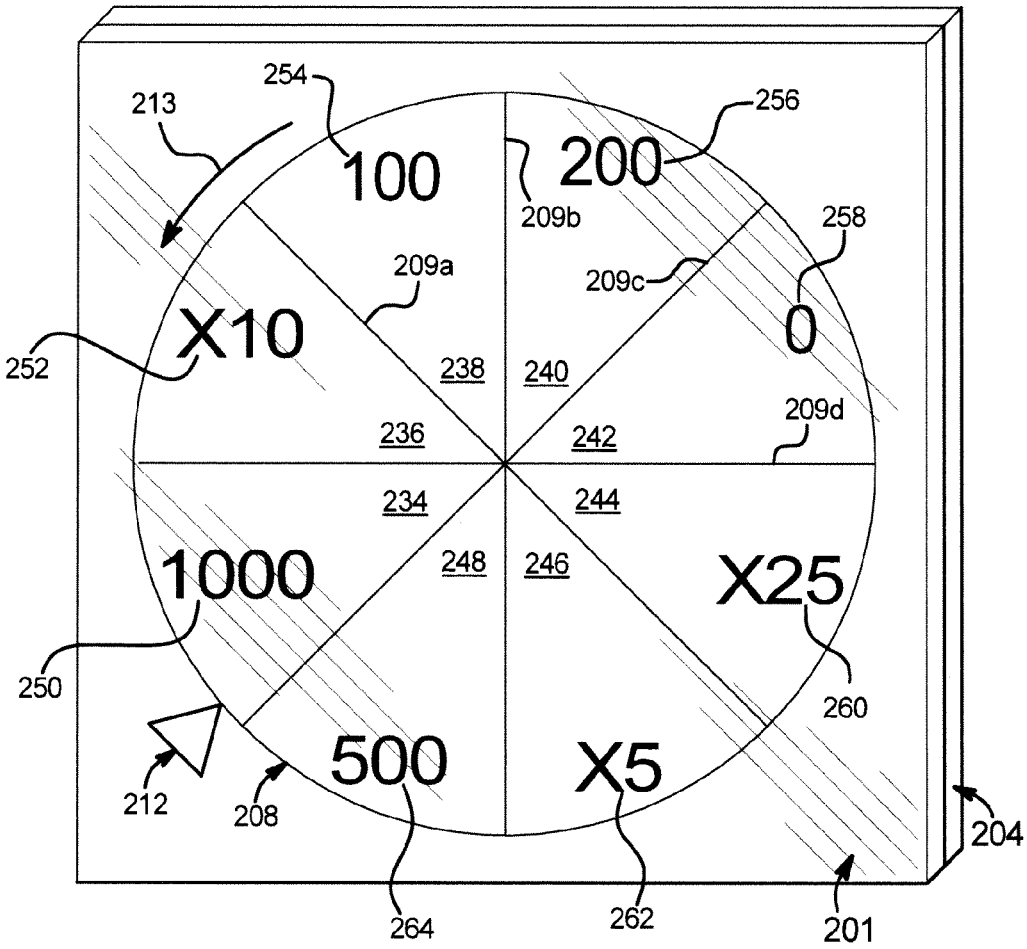
FIG. 6C is an enlarged elevation view of one embodiment of the display device disclosed herein shown removed from the gaming device cabinet illustrating the first and second display screens of FIG. 6A operating together to create a unified game image.

Another alternative embodiment of the present disclosure is illustrated in FIG. 6C. Game images are displayed on first display screen 201. First display screen 201 displays a plurality of game images including awards 250, 252, 254, 256, 258, 260, 262, and 264, as well as an award indicator 212.

As above the first and second display screens 201 and 204 are substantially transparent. The first and second display screens 201 and 204 are configured to enable a player to view mechanical wheel 208 behind first and second display screens 201 and 204. Mechanical wheel 208 is positioned behind and is substantially parallel to second display screen 204. Dividing lines 209*a* to 209*d* are overlaid on top of mechanical wheel 208 and form the same sections in a manner described above.

Awards 250, 252, 254, 256, 258, 260, 262, and 264 are associated with sections 234, 236, 238, 240, 242, 244, 246, and 248 respectively. Additionally, in this embodiment, the awards are displayed in an upright position regardless of where awards 250, 252, 254, 256, 258, 260, 262, and 264 are associated with mechanical wheel 208. As mechanical wheel 208 rotates and the awards 250, 252, 254, 256, 258, 260, 262, and 264 rotate in sync, the awards continue to remain displayed in an upright or substantially upright position such that the player can maintain an easy visual of a desired award as it rotates with the mechanical wheel 208. In the illustrated embodiment, mechanical wheel 208 and the awards stopped rotating. Award indicator 212 indicates that the player won an award associated with the 1000 award 250 and section 234 of mechanical wheel 208. The gaming device provides the player 1000 credits associated with the 1000 award 250.

The present disclosure thus overcomes the above shortcomings by providing a gaming system including at least one and preferably a plurality of gaming devices which each has a display device which includes at least one display screen aligned in front of at least one physical mechanical rotatable wheel. In one embodiment, one or more of the display screens have at least one viewing surface which is or has the capacity to be see-through.

In one embodiment, the gaming device includes a cabinet or other suitable housing which houses the display device, a touch screen sensor in front of the display screens, and a processor connected to a memory device and adapted to control the operation of the gaming device, including player controls, input devices and the display device. The cabinet can include any suitable frame which supports the display device and the other conventional mechanical and electrical components of the gaming device.

As indicated above, the display device of one embodiment of the present disclosure, which is adapted to receive signals from the processor and to generate and display images, includes a plurality of display screens which each generate certain images or portions of images. In one embodiment, the display device includes two display screens, including a first, foremost or exterior display screen and a second, underlying or interior display screen. The two display screens are mounted, oriented and aligned within the cabinet in such a manner that at least one and preferably a plurality of lines of sight intersect both of the viewing surfaces or faces of the display screens.

In one embodiment, a predetermined distance "D" separates the display surfaces of the two display screens. It should be appreciated that the display screens can be positioned, mounted or stacked with a distance separating the display surfaces and little to no distance or space separating the display screens.

The display screens are preferably positioned in different planes which are parallel to one another. However, it should be appreciated that the display screens can be positioned in planes which are not parallel to one another, provided that at least one (and preferably a plurality) of lines of sight intersect the display surfaces of the plurality of the display screens. Also, the display screens are preferably substantially flat, although it should be appreciated that the display screens can have any suitable shape, such as concave and convex shapes and non-uniform shapes.

In one embodiment the touch screen detects or senses pressure and also varying degrees of pressure applied by a player to the touch screen. The player generally applies this pressure perpendicular to the surface of the touch screen. Using one or more programs stored within the memory device, the processor of the gaming device enables a player to activate game elements or functions in a conventional manner by providing pressure to that touch screen. It should also be appreciated that in alternative embodiments, the player can also activate intermediate or interim display screens by applying higher levels of pressure to the touch screen. This functionality enables a player to reach one or more underlying display screens by providing varying levels of pressure to the touch screen. This type of touch screen is commercially available from EL Touch Systems.

In one embodiment, the display screen is relatively flat and thin. For instance, in one embodiment, the display screen may be an LCD panel with a light source (for backlighting) disposed behind the interior LCD panel. It should be appreciated that the display screen can be any suitable display screen such as lead lanthanum titanate (PLZT) panel technology or any other suitable technology which involves a matrix of selectively operable light modulating structures, commonly known as pixels or picture elements.

In another embodiment, the display device includes two display screens which are relatively flat and thin and a interior image or light source. For example, in such embodiment, the backmost image or light source may be a cathode ray tube (CRT) or other light source such as a plasma screen.

In one embodiment of the present disclosure, the display screen is always or has the capacity to be completely or partially see-through such as being translucent or transparent at predetermined times. When the display screen is transparent or translucent, a player can see the images displayed on the display screen as well as the images located behind the display screen and particularly the images displayed by the mechanical wheel. In one embodiment, a second display screen is located behind the display screen. If the second display screen is also transparent or translucent, the second display screen preferably includes a background image or layer which prevents a player from seeing through the underlying display screen into the interior of the cabinet of the gaming device.

Various companies have developed relatively flat display screens which have the capacity to be transparent or translucent. One such company is Tralas Technologies, Inc., which sells display screens which employ time multiplex optical shutter (TMOS) technology. This TMOS display technology involves: (a) selectively controlled pixels which shutter light out of a light guidance substrate by violating the light guidance conditions of the substrate; and (b) a system for repeatedly causing such violation in a time multiplex fashion. The display screens which embody TMOS technology are inherently transparent and they can be switched to display colors in any pixel area. Certain TMOS display technology is described in U.S. Pat. No. 5,319,491.

Another company, Deep Video Imaging Ltd., produces display screens which have the capability of being translucent or transparent. The display screens sold by Deep Video Imaging Ltd. include 2(TFT) LCD panels. One product sold by Deep Video Imaging Ltd. is a display device which includes a plurality of TFT LCD panels positioned within the display device. It should be appreciated that the gaming device of the present invention can employ any suitable display material or display screen which has the capacity to be transparent or translucent. For example, such a display screen can include holographic shutters or other suitable technology.

The gaming device of the present disclosure can also use the display device to display different images on the different display screens which a player can simultaneously view by looking at and thus through at least an exterior most display screen. In one example, the exterior display screen displays a video reel image on one portion of the exterior display screen while the other portions of the exterior display screen are transparent. The interior display screen displays a paytable image and a background image. When the exterior display screen and the interior display screen both display their images simultaneously, the player can simultaneously view the overall graphical representation or display of the reel image, paytable image and background image.

In another embodiment, the gaming device generates a game image on the exterior display screen and a flashing translucent image on the interior display screen. The underlying flashing image could, for example, be a payline or a symbol or message which provides a player with helpful information such as a hint for playing the game. In operation, the player could play the game while periodically viewing the flashing image without having to change his or her line of sight or having to independently request such information.

In another embodiment, the gaming device enables a player to play two or more games on two or more display screens at the same time or at different times. For example, a player can play two related games on two of the display screens simultaneously. In another example, once a player deposits currency to initiate the gaming device, the gaming device may enable the player to chose from one or more games to play on different display screens. In another example, the gaming device can include a multi-level bonus scheme which enables a player to advance to different bonus rounds which are displayed and played on different display screens.

As indicated above, the gaming device of the present disclosure can also enable players to view information and graphics generated on one display screen while playing a game that is generated on another display screen. Such information and graphics can include game paytables, game-related information, entertaining graphics, background, history or game theme-related information or information not related to the game, such as advertisements. The gaming device can display this information and graphics adjacent to a game, underneath or behind a game or on top of a game. For example, a gaming device could display a reel game on the first display screen and also display paylines on a second display screen, and the paylines could fade in and fade out periodically.

It should also be appreciated that the above gaming device enables a mechanical wheel to be used in a server based gaming environment. In a server based gaming environment, a plurality of different games can be delivered to and/or stored in the gaming device. The gaming device can thus provide a plurality of different games on the display screen(s) that may or may not interact with the mechanical wheel that is located behind the display screen(s).

The gaming device of the present disclosure overcomes the drawback of not being able to incorporate a mechanical wheel in a server based gaming device. The display device of the present disclosure remedies enables the display screen to display the actual awards or outcomes for the mechanical wheel. Thus, the mechanical wheel can be adapted to any game being played or does not need to be employed at all. For instance, a first game may have small values associated with the mechanical wheel because the game appears frequently. On the other hand, a second game may have large values associated with the mechanical wheel because the game appears infrequently. A server based embodiment of the gaming device enables the mechanical wheel to be used for both games as the display screen is capable of easily changing the values that will be displayed on the mechanical wheel. In this manner, the mechanical wheel can be associated with a server based game system that is capable of providing a plurality of different games with different awards or symbols. Each game may incorporate the mechanical wheel in a fundamentally different manner. Thus, the gaming device of the present disclosure provides a server based embodiment that enables a plurality of different wheel based games to be played on a single gaming device.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is claimed as follows:

1. A gaming device comprising:

a housing;

at least one input device supported by the housing;

at least one display device including a display screen supported by the housing and a rotatable mechanical wheel supported by the housing which is:

(i) positioned behind the display screen, and (ii) aligned with the display screen such that a plurality of lines of sight extend through the display screen and such that the mechanical wheel can be seen through the display screen; and at least one processor programmed to operate with the display screen and the mechanical wheel to:

(a) cause the display screen to display a plurality of game functional images each in alignment with one of a plurality of different sections of the mechanical wheel to create a combined unified visible image of the game functional images and the mechanical wheel, (b) simultaneously cause the mechanical wheel and the displayed game functional images to rotate at a same rate such that the game functional images maintain alignment with the respective different sections during said synchronized rotation, (c) after said synchronized rotation, cause an indication of one of the game functional images in alignment with its respective section of the mechanical wheel, and (d) cause an award to be provided to a player based on the indicated game functional image.

2. The gaming device of claim 1, wherein the plurality of game functional images include symbols.

3. The gaming device of claim 1, wherein at least one of the game functional images is a video reel including a plurality of symbols.

4. The gaming device of claim 1, wherein at least one of the game functional images is a video wheel including a plurality of symbols.

5. The gaming device of claim 1, which includes an actuator configured to change a distance between the display screen and the mechanical wheel.

6. The gaming device of claim 1, wherein at least a portion of the display screen is configured to be selectively substantially opaque such that the mechanical wheel is not visible.

7. The gaming device of claim 1, wherein the display screen is configured to display a primary game, wherein the primary game renders the display screen opaque and substantially obstructs view of the mechanical wheel.

8. The gaming device of claim 1, wherein the mechanical wheel includes a plurality of delineated sections.

9. The gaming device of claim 1, wherein the display screen is configured to display a plurality of delineated sections for the mechanical wheel.

10. A gaming device comprising:

a housing;

at least one input device supported by the housing;

at least one display device supported by the housing, the display device including:

(i) a plurality of display screens supported by the housing, wherein each display screen is positioned a predetermined distance from each other, and (ii) a rotatable mechanical wheel supported by the housing, positioned behind the plurality of display screens, and aligned with the plurality of display screens such that a plurality of lines of sight extend through the display screens and such that the mechanical wheel can be seen through the plurality of display screens; and at least one processor programmed to operate with the plurality of display screens and the mechanical wheel to:

(a) cause at least one of the display screens located to display a plurality of symbols each in alignment with one of a plurality sections of the mechanical wheel, (b) simultaneously cause the mechanical wheel and displayed symbols to rotate at a same rate such that the symbols maintain alignment with the respective different sections during said synchronized rotation, (c) after said synchronized rotation, cause an indication of one of the symbols in alignment with its respective section of the mechanical wheel, and (d) cause an award to be provided to a player based on the indicated symbol.

11. The gaming device of claim 10, wherein a first one of the display screens is configured to display a plurality of primary game functional images and become substantially opaque such that a second one of the display screens and the mechanical wheel are not visible.

12. The gaming device of claim 10, wherein the symbols are displayed by a first one of the display screens and a second one of the display screens.

13. The gaming device of claim 10, which includes an actuator configured to change the distance between a first one of the display screens and a second one of the display screens.

14. The gaming device of claim 10, which includes an actuator configured to change the distance between a second one of the display screens and the mechanical wheel.

15. The gaming device of claim 14, wherein sizes of the plurality of symbols displayed by the second display screen are different if the distance between the second display screen and the mechanical wheel changes.

16. The gaming device of claim 10, wherein the plurality of displayed symbols maintain their orientation and alignment with the respective different sections of the mechanical wheel when the plurality of symbols and the mechanical wheel are rotated such that the plurality of displayed symbols do not remain upright while rotating.

17. The gaming device of claim 10, wherein the plurality of displayed symbols remain upright while rotating.

* * * * *

UNITED STATES PATENT AND TRADEMARK OFFICE

CERTIFICATE OF CORRECTION

PATENT NO. : 8,210,944 B2
APPLICATION NO. : 11/927047
DATED : July 3, 2012
INVENTOR(S) : Dennis K. Mead It is certified that error appears in the above-identified patent and that said Letters Patent is hereby corrected as shown below:

In Claim 7, Column 31, Line 50, between “obstructs” and “view” insert --a--.
In Claim 10, Column 32, Line 17, delete “located”.
In Claim 15, Column 32, Line 44, between “second” and “display” insert --one of the--, and replace “screen” with --screens--.
In Claim 15, Column 32, Line 45, between “second” and “display” insert --one of the--, and replace “screen” with --screens--.
In Claim 16, Column 32, Line 48, replace “orientation” with --orientations-- and “alignment” with --alignments--.

Signed and Sealed this
Fourth Day of September, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,210,944 B2
APPLICATION NO. : 11/927047
DATED : July 3, 2012
INVENTOR(S) : Mead It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1100 days.

Signed and Sealed this
Twenty-third Day of October, 2012

David J. Kappos

David J. Kappos
*Director of the United States Patent and Trademark Office*